US005629142A

United States Patent [19]

Maskasky

[11] Patent Number: 5,629,142

[45] **Date of Patent: *May 13, 1997**

[54] DUAL COATING RADIOGRAPHIC ELEMENTS CONTAINING TABULAR GRAIN EMULSIONS WITH IMPROVED PHOTOGRAPHIC VEHICLES

[75] Inventor: Joe E. Maskasky, Rochester, N.Y.

[73] Assignee: Eastman Kodak Company, Rochester, N.Y.

[ * ] Notice: The term of this patent shall not extend beyond the expiration date of Pat. No. 5,604,085.

[21] Appl. No.: 574,884

[22] Filed: Dec. 19, 1995

[51] Int. Cl.[6] ..... G03C 5/17; G03C 5/16

[52] U.S. Cl. ..... 430/502; 430/567; 430/603; 430/605; 430/639; 430/641; 430/966

[58] Field of Search ..... 430/502, 567, 430/966, 603, 605, 639, 641

[56] References Cited

U.S. PATENT DOCUMENTS

| | | | |
|---|---|---|---|
| 4,374,673 | 2/1983 | Aldrich | 106/212 |
| 4,400,463 | 8/1983 | Maskasky | 430/434 |
| 4,414,304 | 11/1983 | Dickerson | 430/353 |
| 4,425,425 | 1/1984 | Abbott et al. | 430/502 |
| 4,713,320 | 12/1987 | Maskasky | 430/567 |
| 4,713,323 | 12/1987 | Maskasky | 430/569 |
| 5,284,744 | 2/1994 | Maskasky | 430/569 |
| B1 4,425,426 | 9/1988 | Abbott et al. | 430/502 |

OTHER PUBLICATIONS

Mees, *The Theory of the Photographic Process*, Revised Ed., Macmillan 1951, pp. 48 and 49.

James *The Theory of the Photographic Process*, 4th Ed., Macmillan, 1977, p. 51.

*Research Disclosure*, vol. 365, Sep. 1994, Item 36544.

*Research Disclsoure*, vol. 176, Dec. 1978, Item 17643.

*Primary Examiner*—Thorl Chea

*Attorney, Agent, or Firm*—Carl O. Thomas

[57] ABSTRACT

A dual coated radiographic element is disclosed including at least one radiation-sensitive emulsion comprised of silver halide grains containing greater than 50 mole percent bromide and less than 4 mole percent iodide, based on silver, with greater than 50 percent of total grain projected area being accounted for by tabular grains having {111} major faces, a spectral sensitizing dye adsorbed to the surfaces of the silver halide grains, and hydrophilic colloid vehicle acting as a peptizer and a binder for the silver halide grains. At least the portion of the vehicle acting as a peptizer is a hydrophilic colloid derived from a water dispersible cationic starch.

19 Claims, 1 Drawing Sheet

DUAL COATING RADIOGRAPHIC ELEMENTS CONTAINING TABULAR GRAIN EMULSIONS WITH IMPROVED PHOTOGRAPHIC VEHICLES

CROSS REFERENCE TO RELATED APPLICATION

Reference is made to and priority claimed from U.S. Provisional application U.S. Ser. No. 60/002,105, filed 10 Aug. 1995, entitled DUAL COATED RADIOGRAPHIC ELEMENTS CONTAINING TABULAR GRAIN EMULSIONS WITH IMPROVED PHOTOGRAPHIC VEHICLES.

FIELD OF THE INVENTION

The invention is directed to an improvement in radiographic elements. More specifically, the invention is directed to radiographic elements that employ high bromide {111} tabular grain silver halide emulsions.

DEFINITION OF TERMS

The term "radiographic element" refers to an element intended to record a pattern of X-radiation. This includes indirect radiographic elements that rely on an intensifying screen to absorb X-radiation and emit a corresponding pattern of light for recording by the radiographic element.

The term "dual coated" refers to radiographic elements that contain image recording units on opposite sides of an X-radiation transmissive support. Thus, dual coated radiographic elements are quite different than "double coated" or "triple coated" photographic elements that contain multiple silver halide emulsion layers on a single side of a support.

The term "equivalent circular diameter" or "ECD" is employed to indicate the diameter of a circle having the same projected area as a silver halide grain.

The term "aspect ratio" designates the ratio of grain ECD to grain thickness (t).

The term "tabularity" is defined as $ECD/t^2$, where ECD and t are both measured in micrometers (μm).

The term "tabular grain" indicates a grain having two parallel crystal faces which are clearly larger than any remaining crystal face and having an aspect ratio of at least 2.

The term "tabular grain emulsion" refers to an emulsion in which tabular grains account for greater than 50 percent of total grain projected area.

The term "high bromide" in referring to grains and emulsions indicates that bromide is present in concentrations of greater than 50 mole percent, based on total silver.

In referring to grains and emulsions containing two or more halides, the halides are named in order of ascending concentrations.

The term "{111} tabular" is employed in referring to tabular grains and tabular grain emulsions in which the tabular grains have {111} major faces.

The terms "hydrophilic colloid vehicle" and "vehicle" refer to the hydrophilic colloid peptizers and binders present in silver halide emulsions.

The terms "selected vehicle" and "selected peptizer" are employed to designate vehicle or peptizer derived from a water dispersible cationic starch.

The term "cationic" in referring to starch indicates that the starch molecule has a net positive charge at the pH of intended use.

The term "oxidized" in referring to starch indicates a starch in which, on average, at least one α-D-glucopyranose repeating unit per starch molecule has been ring opened by cleavage of the 2 and 3 ring position carbon-to-carbon bond.

The term "water dispersible" in referring to cationic starches indicates that, after boiling the cationic starch in water for 30 minutes, the water contains, dispersed to at least a colloidal level, at least 1.0 percent by weight of the total cationic starch.

The term "middle chalcogen" designates sulfur, selenium and/or tellurium.

BACKGROUND

Radiation-sensitive silver halide emulsions employed in radiographic elements are comprised of a dispersing medium and silver halide microcrystals, commonly referred to as grains. As the grains are precipitated from an aqueous medium, a hydrophilic colloid peptizer is adsorbed to the grain surfaces to prevent the grains from agglomerating. Subsequently binder is added to the emulsion and, after coating, the emulsion is dried. The peptizer and binder are collectively referred to as the vehicle of an emulsion.

Gelatin and gelatin derivatives form both the peptizer and the major portion of the remainder of the vehicle in the overwhelming majority of silver halide radiographic elements. An appreciation of gelatin is provided by this description contained in Mees *The Theory of the Photographic Process,* Revised Ed., Macmillan, 1951, pp. 48 and 49:

> Gelatin is pre-eminently a substance with a history; its properties and its future behavior are intimately connected with its past. Gelatin is closely akin to glue. At the dawn of the Christian era, Pliny wrote, "Glue is cooked from the hides of bulls." It is described equally shortly by a present-day writer as "the dried down soup or consommé of certain animal refuse." The process of glue making is age-old and consists essentially in boiling down hide clippings or bones of cattle and pigs. The filtered soup is allowed to cool and set to a jelly which, when cut and dried on nets, yields sheets of glue or gelatin, according to the selection of stock and the process of manufacture. In the preparation of glue, extraction is continued until the ultimate yield is obtained from the material; in the case of gelatin, however, the extraction is halted earlier and is carried out at lower temperatures, so that certain strongly adhesive but nonjelling constituents of glue are not present in gelatin. Glue is thus distinguished by its adhesive properties; gelatin by its cohesive properties, which favor the formation of strong jellies.
>
> Photographic gelatin is generally made from selected clippings of calf hide and ears as well as cheek pieces and pates. Pigskin is used for the preparation of some gelatin, and larger quantities are made from bone. The actual substance in the skin furnishing the gelatin is collagen. It forms about 35 per cent of the coria of fresh cattle hide. The corresponding tissue obtained from bone is termed ossein. The raw materials are selected not only for good structural quality but for freedom from bacterial decomposition. In preparation for the extraction, the dirt with loose flesh and blood is eliminated in a preliminary wash. The hair, fat, and much of the albuminous materials are removed by soaking the stock in limewater containing suspended lime. The free lime continues to rejuvenate the solution and keeps the bath at suitable alkalinity. This operation is followed by deliming with dilute acid, washing, and cooking to extract the gelatin. Several "cooks" are made at increasing temperatures, and usually the products of the last extractions are not employed for photographic gelatin. The crude gelatin solution is filtered, concentrated if necessary, cooled until it sets, cut up, and dried in slices. The residue, after extraction of the gelatin, consists chiefly of elastin and reticulin with some keratin and albumin.

Gelatin may also be made by an acid treatment of the stock without the use of lime. The stock is treated with dilute acid (pH 4.0) for one to two months and then washed thoroughly, and the gelatin is extracted. This gelatin differs in properties from gelatin made by treatment with lime.

In addition to the collagen and ossein sought to be extracted in the preparation of gelatin there are, of course, other materials entrained. For example, James *The Theory of the Photographic Process,* 4th Ed., Macmillan, 1977, p. 51, states:

Although collagen generally is the preponderant protein constituent in its tissue of origin, it is always associated with various "ground substances" such as noncollagen protein, mucopolysaccharides, polynucleic acid, and lipids. Their more or less complete removal is desirable in the preparation of photographic gelatin.

Superimposed on the complexity of composition is the variability of composition, attributable to the varied diets of the animals providing the starting materials. The most notorious example of this was provided by the forced suspension of manufacturing by the Eastman Dry Plate Company in 1882, ultimately attributed to a reduction in the sulfur content in a purchased batch of gelatin.

Considering the time, effort, complexity and expense involved in gelatin preparation, it is not surprising that research efforts have in the past been mounted to replace the gelatin used in photographic emulsions and other film layers. However, by 1970 any real expectation of finding a generally acceptable replacement for gelatin had been abandoned. A number of alternative materials have been identified as having peptizer utility, but none have found more than limited acceptance. Of these, cellulose derivatives are by far the most commonly named, although their use has been restricted by the insolubility of cellulosic materials and the extensive modifications required to provide peptizing utility.

*Research Disclosure,* Vol. 365, September 1994, Item 36544, II. Vehicles, vehicle extenders, vehicle-like addenda and vehicle related addenda, A. Gelatin and hydrophilic colloid peptizers, paragraph (1) states:

(1) Photographic silver halide emulsion layers and other layers on photographic elements can contain various colloids alone or in combination as vehicles. Suitable hydrophilic materials include both naturally occurring substances such as proteins, protein derivatives, cellulose derivatives—e.g., cellulose esters, gelatin—e.g., alkali-treated gelatin (pigskin gelatin), gelatin derivatives—e.g., acetylated gelatin, phthalated gelatin and the like, polysaccharides such as dextran, gum arabic, zein, casein, pectin, collagen derivatives, collodion, agar-agar, arrowroot, albumin and the like . . .

This description is identical to that contained in *Research Disclosure,* Vol. 176, December 1978, Item 17643, IX. Vehicles and vehicle extenders, paragraph A. *Research Disclosure* is published by Kenneth Mason Publications, Ltd., Dudley House, 12 North St., Emsworth, Hampshire P010 7DQ, England.

During the 1980's a marked advance took place in radiographic elements containing silver halide emulsions. Abbott et al U.S. Pat. No. 4,425,425 disclosed that dual coated radiographic elements employing spectrally sensitized high (>8) aspect ratio tabular grain emulsions exhibited reduced crossover. Abbott et al U.S. Pat. No. 4,425,426 extended these observations to radiographic elements employing thin (<0.2 μm) intermediate (5–8) aspect ratio tabular grain emulsions. Dickerson et al U.S. Pat. No. 4,414,304 discloses radiographic elements containing tabular grain emulsions that are fully forehardened, resulting from the observation that tabular grain emulsions, unlike the emulsions previously employed in radiographic elements, exhibit high covering power characteristics that are minimally affected by increased hardening of the emulsion vehicle. Based on these advantages of dual coated radiographic elements an industry conversion to tabular grain emulsions has occurred.

In the descriptions of high bromide {111} tabular grain emulsions provided by Abbott et al and Dickerson, cited above, the vehicle disclosure of *Research Disclosure* Item 17643 was incorporated verbatim. Only gelatin peptizers were actually demonstrated in the Examples.

Despite the assumption that conventional vehicle selections are fully applicable to tabular grain emulsions, there have been some indications that some peptizer selections are particularly advantageous for tabular grain emulsions. Maskasky U.S. Pat. No. 4,400,463 disclosed the use of synthetic peptizers in combination with adenine to produce high (>50 mole %) chloride tabular emulsions. Later Maskasky U.S. Pat. Nos. 4,713,320 and 4,713,323 demonstrated that high bromide and high chloride tabular grain emulsions could be improved by treating gelatin with an oxidizing agent.

Maskasky U.S. Pat. No. 5,284,744 taught the use of potato starch as a peptizer for the preparation of cubic grain silver halide emulsions, noting that potato starch has a lower absorption, compared to gelatin, in the wavelength region of from 200 to 400 nm. Maskasky '744 does not disclose tabular grain emulsions.

Problems to be Solved

Notwithstanding the industry acknowledged advances that tabular grain emulsions have made possible in dual coated radiographic elements, there have remained problems, some unique to dual coated radiographic elements and some that are shared with all elements that employ silver halide emulsions. Some of these problems have been assiduously pursued in the hope that a solution can be found while other problems have received little recent attention, being accepted as inescapable limitations of silver halide emulsions.

Silver halide emulsions intended for photographic applications have found it advantageous to reduce the thickness of the tabular grains to the lowest levels that can be reliably obtained. Therefore, recent interest has been directed to ultrathin (<0.07 μm in thickness) tabular grain emulsions. In radiography a minimum average tabular grain thickness of about 0.1 μm is common. The greater thickness of the tabular grains in radiography is dictated by the warmer image tones produced as tabular grain thicknesses are reduced. In medical diagnostic imaging, the primary use of dual coated radiographic elements, radiologists prefer radiographic images with "cold" image tones. Warm image tone has represented an obstacle to realizing the advantages of tabular grain emulsions exhibiting average grain thicknesses of less than 0.1 μm. The incorporation of ultrathin tabular grains into a dual coated radiographic element increases the surface to volume ratio of the tabular grains, allowing higher levels of spectral sensitizing dye per unit of silver to be employed, thereby reducing crossover.

The cost and inconvenience of the preparation of gelatin and gelatin derived vehicles has become generally accepted, since no more attractive substitutes have been found, despite investigations that have been spread over a century.

Conventional peptizers obtained from gelatin, cellulose and starch, when employed as aqueous peptizers in forming silver halide emulsions, exhibit levels of viscosity well above the viscosity of water. Further, viscosities increase markedly as temperatures are lowered to approach room temperature (nominally 20° C.), and for this reason silver halide emulsion precipitations are typically undertaken in the temperature range of from 30° to 90° C.

The elevated viscosity levels imparted by these peptizers, even at the elevated temperatures employed for silver halide precipitation, interfere with reactant mixing to obtain uniform grain characteristics. For example, elevated viscosities work against uniform mixing on a microscale (micromixing) which is essential for uniform grain nucleation and growth. Nonuniformity in grain nucleation and, to a lesser extent, growth result in grain polydispersity, including the coprecipitation of grains that differ in their shape and size and, where multiple halides are being coprecipitated, their internal distribution of halides.

On a macroscale the elevated levels of viscosity create difficulties in scaling up the silver halide precipitations to convenient volumes for manufacturing purposes. Elevated levels of viscosity work against being able to sustain desired levels of bulk mixing of reactants as the total volume of the reaction vessel is increased.

The peptizer polymers, being of natural origin, contain mixtures of differing molecules, differing in weight and structure, not all of which are well suited to emulsion preparation. Further, the peptizers exhibit variations based on origin of the starting materials and can vary in composition over time, even when obtained from a single commercial source. Unwanted effects can be seen both in physical properties, such as turbidity, and in sensitometric properties, such as fog.

It is generally accepted that heating of silver halide emulsions is required to achieve chemical sensitization by any one or combination of middle chalcogen (i.e., sulfur, selenium and/or tellurium), noble metal (e.g., gold) or reduction sensitization. For achieve anywhere near maximum acceptable photographic speeds heating to at least about 50° C. is typical, with maximum temperatures being limited only by ambient vapor pressures (e.g., boiling away of the aqueous component). At these elevated temperatures grain ripening is accelerated. This can lead to varied unwanted effects, depending upon the nature of the grains present in the emulsion and their intended end use. Ripening, for example, rounds grain edges and corners of surviving grains, eliminates smaller grains entirely, and can destroy useful grain characteristics (e.g., deleterious thickening of tabular grains can be produced by ripening). Particularly sensitive to unwanted ripening are ultrathin (thickness <0.07 μm) tabular grain emulsions, which can exhibit mean grain thickness increases of in excess of 30 percent (and much higher) when ripening occurs at conventional chemical sensitization temperatures. Further, elevated temperatures during grain precipitation can also accelerate unwanted ripening and degrade desired grain characteristics.

Finally, the starches that have been heretofore investigated as peptizers have been generally observed to be clearly inferior in their peptizing action. Additionally, conventional starch peptizers, as demonstrated by Maskasky U.S. Pat. No. 5,274,644, cited above, favor the formation of grains having {100} crystal faces, whereas high bromide tabular grains require {111} faces in the forms that have found acceptance in practical use.

RELATED APPLICATIONS

Maskasky U.S. Ser. No. 08/574,833, filed Dec. 19, 1995, commonly assigned, and now allowed, titled HIGH BROMIDE ULTRATHIN TABULAR GRAIN EMULSIONS IMPROVED BY PEPTIZER SELECTION, is directed to high bromide ultrathin {111} tabular grain emulsions containing as a peptizer a water dispersible cationic starch.

Maskasky U.S. Ser. No. 08/643,225, filed May 2, 1996, as a continuation-in-part of U.S. Ser. No. 574,664, filed Dec. 19, 1995, commonly assigned, titled HIGH BROMIDE TABULAR GRAIN EMULSIONS IMPROVED BY PEPTIZER SELECTION, is directed to high bromide {111} tabular grain emulsions with mean grain thicknesses ranging from 0.07 to 0.3 μm containing as a peptizer a water dispersible cationic starch.

Maskasky U.S. Ser. No. 08/662,300, filed Jun. 12, 1996, as a continuation-in-part of U.S. Ser. No. 574,834, field Dec. 19, 1995, commonly assigned, titled PHOTOGRAPHIC EMULSIONS IMPROVED BY PEPTIZER MODIFICATION, is directed to silver halide emulsions containing an oxidized cationic starch as a peptizer.

Maskasky U.S. Ser. No. 08/662,904, filed Jun. 12, 1996, as a continuation-in-part of U.S. Ser. No. 574,849, filed Dec. 19, 1995, commonly assigned, titled HIGH BROMIDE ULTRATHIN TABULAR GRAIN EMULSIONS IMPROVED BY PEPTIZER MODIFICATION, is directed to a high bromide ultrathin {111} tabular grain emulsion containing an oxidized cationic starch as a peptizer.

SUMMARY OF THE INVENTION

In one aspect the invention is directed to a radiographic element comprised of a transparent film support and first and second emulsion layer units coated on opposite sides of the support, each including at least one radiation-sensitive emulsion comprised of (a) silver halide grains containing greater than 50 mole percent bromide and less than 4 mole percent iodide, based on silver, with greater than 50 percent of total grain projected area being accounted for by tabular grains having {111} major faces, (b) a spectral sensitizing dye adsorbed to the surfaces of the silver halide grains, and (c) hydrophilic colloid vehicle acting as a peptizer and a binder for the silver halide grains, wherein at least the portion of the vehicle acting as a peptizer is a hydrophilic colloid derived from a water dispersible cationic starch.

It has been discovered quite surprisingly that cationic starches are better suited for preparing high bromide {111} tabular grain emulsions than non-cationic starches and that cationic starches, when present in place of gelatin, facilitate imaging advantages.

Cationic starches exhibit lower levels of viscosity than have previously been present in preparing tabular grain emulsions, and viscosity is reduced even further when the cationic starch is oxidized. Reduced viscosity facilitates more uniform mixing. Both micromixing, which controls the uniformity of grain composition, mean grain size and dispersity, and bulk mixing, which controls scale up of precipitations to convenient manufacturing scales, are favorably influenced by the reduced viscosities made possible by cationic starch peptizers. Precise control over grain nucleation, including the monodispersity of the grain nuclei, is particularly important to successfully achieving and improving the properties of tabular grain emulsions.

Under comparable levels of chemical sensitization higher imaging speeds can be realized with cationic starches. Alternatively, lower temperatures can be employed during chemical sensitization of cationic starch peptized tabular grain emulsions to achieve imaging speeds equal or superior to those of gelatino-peptized emulsions. Lower temperatures have the advantage of protecting the tabular grains from unwanted ripening during chemical sensitization.

Oxidized cationic starch allow emulsion precipitation at ambient temperature. Additionally, oxidized cationic starch allows chemical sensitization at even lower temperatures than cationic starches in general.

DESCRIPTION OF PREFERRED EMBODIMENTS

Figure 1:
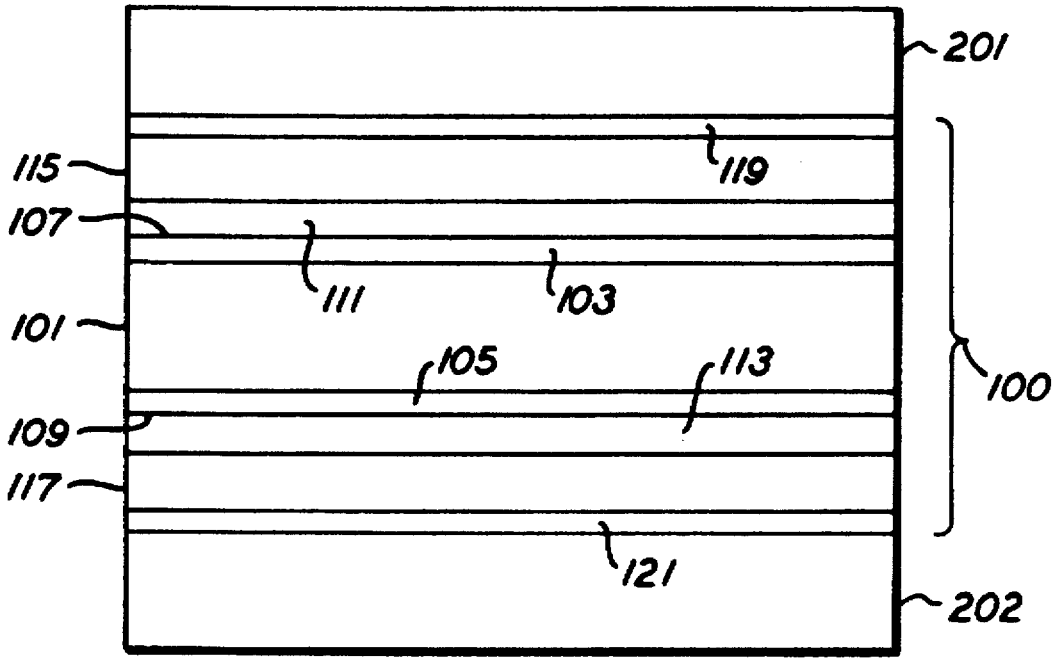
FIG. 1 is a schematic diagram of an assembly consisting of a dual coated radiographic element mounted between two intensifying screens.

A general appreciation of dual coated radiographic element construction can be obtained by reference to FIG. 1, wherein an assembly is shown consisting of a dual coated radiographic element 100 according to the invention positioned between a pair of light emitting intensifying screens 201 and 202. The radiographic element is comprised of a transparent film support 101, typically blue tinted, capable of transmitting both light and X-radiation to which it is exposed. The film support optionally includes subbing layers 103 and 105 to facilitate adhesion of coated layers. On the first and second major faces 107 and 109 of the support formed by the subbing layers are optional crossover reducing hydrophilic colloid layers 111 and 113, respectively. Overlying the crossover reducing layers are emulsion layer units 115 and 117 comprised of one or more hydrophilic colloid layers, including at least one silver halide emulsion layer. Optional, but preferably included, hydrophilic colloid protective overcoat layers 119 and 121 overlie the emulsion layer units.

In use the assembly is imagewise exposed to X-radiation. The X-radiation is principally absorbed by the intensifying screens 201 and 202, which promptly emit light as a direct function of X-radiation exposure. Light emitted by the screen 201 primarily exposes the emulsion layer unit 115 while light emitted by the screen 202 primarily exposes the emulsion layer unit 117. Following imagewise exposure the radiographic element is separated from the intensifying screens and processed (developed, fixed and washed) to produce a silver image in each of the emulsion layer units. The two silver images, being superimposed, are seen as a single radiographic image when viewed on a translucent light box.

To achieve the highest attainable levels of imaging performance each emulsion layer unit contains at least one high bromide {111} tabular grain emulsion. To enhance light absorption by the grains forming the emulsion and to reduce image sharpness degrading crossover (light passing from an intensifying screen on one side of the support to an emulsion layer on the opposite side of the support), at least one spectral sensitizing dye is adsorbed to the grain surfaces. The optional crossover reducing layer typically contains microcrystalline dye particles to reduce crossover further. To permit transmission viewing of the silver images the microcrystalline dye particles are chosen to be decolorized during processing.

To allow processing solutions to penetrate the protective overcoats, emulsion layers, and crossover reducing layers, these layers employ water permeable hydrophilic colloid vehicles. In the protective overcoats and the crossover reducing layers the sole function of the vehicle is to act as a binder. In the emulsion layers the vehicle acts both as a binder for coating integrity and as a peptizer for the silver halide grains.

A distinguishing feature of the radiographic elements of the invention is that at least that portion of the hydrophilic colloid forming the radiographic element that is used as a peptizer for the high bromide {111} tabular grain emulsion is derived from a water dispersible cationic starch.

The term "starch" is employed to include both natural starch and modified derivatives, such as dextrinated, hydrolyzed, oxidized, alkylated, hydroxyalkylated, acetylated or fractionated starch. The starch can be of any origin, such as corn starch, wheat starch, potato starch, tapioca starch, sago starch, rice starch, waxy corn starch or high amylose corn starch.

Starches are generally comprised of two structurally distinctive polysaccharides, α-amylose and amylopectin. Both are comprised of α-D-glucopyranose units. In α-amylose the α-D-glucopyranose units form a 1,4-straight chain polymer. The repeating units take the following form:

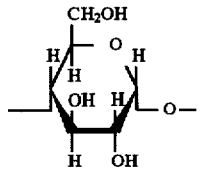

(I)

In amylopectin, in addition to the 1,4-bonding of repeating units, 6-position chain branching (at the site of the —$CH_2OH$ group above) is also in evidence, resulting in a branched chain polymer. The repeating units of starch and cellulose are diasteroisomers that impart different overall geometries to the molecules. The α anomer, found in starch and shown in formula I above, results in a polymer that is capable of crystallization and some degree of hydrogen bonding between repeating units in adjacent molecules, but not to the same degree as the β anomer repeating units of cellulose and cellulose derivatives. Polymer molecules formed by the β anomers show strong hydrogen bonding between adjacent molecules, resulting in clumps of polymer molecules and a much higher propensity for crystallization. Lacking the alignment of substituents that favors strong intermolecular bonding, found in cellulose repeating units, starch and starch derivatives are much more readily dispersed in water.

The water dispersible starches employed in the practice of the invention are cationic—that is, they contain an overall net positive charge when dispersed in water. Starches are conventionally rendered cationic by attaching a cationic substituent to the α-D-glucopyranose units, usually by esterification or etherification at one or more free hydroxyl sites. Reactive cationogenic reagents typically include a primary, secondary or tertiary amino group (which can be subsequently protonated to a cationic form under the intended conditions of use) or a quaternary ammonium, sulfonium or phosphonium group.

To be useful as a peptizer the cationic starch must be water dispersible. Many starches disperse in water upon heating to temperatures up to boiling for a short time (e.g., 5 to 30 minutes). High sheer mixing also facilitates starch dispersion. The presence of cationic substituents increases the polar character of the starch molecule and facilitates dispersion. The starch molecules preferably achieve at least a colloidal level of dispersion and ideally are dispersed at a molecular level—i.e., dissolved.

The following teachings, the disclosures of which are here incorporated by reference, illustrate water dispersible cationic starches within the contemplation of the invention:

*Rutenberg et al U.S. Pat. No. 2,989,520;
Meisel U.S. Pat. No. 3,017,294;
Elizer et al U.S. Pat. No. 3,051,700;
Aszolos U.S. Pat. No. 3,077,469;
Elizer et al U.S. Pat. No. 3,136,646;
*Barber et al U.S. Pat. No. 3,219,518;
*Mazzarella et al U.S. Pat. No. 3,320,080;
Black et al U.S. Pat. No. 3,320,118;
Caesar U.S. Pat. No. 3,243,426;
Kirby U.S. Pat. No. 3,336,292;
Jarowenko U.S. Pat. No. 3,354,034;
Caesar U.S. Pat. No. 3,422,087;
*Dishburger et al U.S. Pat. No. 3,467,608;
*Beaninga et al U.S. Pat. No. 3,467,647;
Brown et al U.S. Pat. No. 3,671,310;
Cescato U.S. Pat. No. 3,706,584;
Jarowenko et al U.S. Pat. No. 3,737,370;
*Jarowenko U.S. Pat. No. 3,770,472;
Moser et al U.S. Pat. No. 3,842,005;
Tessler U.S. Pat. No. 4,060,683;
Rankin et al U.S. Pat. No. 4,127,563;
Huchette et al U.S. Pat. No. 4,613,407;
Blixt et al U.S. Pat. No. 4,964,915;
*Tsai et al U.S. Pat. No. 5,227,481; and
*Tsai et al U.S. Pat. No. 5,349,089.

In a specifically preferred form the starch is oxidized either before (* patents above) or following the addition of cationic substituents. This is accomplished by treating the starch with a strong oxidizing agent. Both hypochlorite ($ClO^-$) or periodate ($IO_4^-$) have been extensively used and investigated in the preparation of commercial starch derivatives and are preferred. While any convenient counter ion can be employed, preferred counter ions are those fully compatible with silver halide emulsion preparation, such as alkali and alkaline earth cations, most commonly sodium, potassium or calcium.

When the oxidizing agent opens the α-D-glucopyranose ring, the oxidation sites are at the 2 and 3 position carbon atoms forming the α-D-glucopyranose ring. The 2 and 3 position

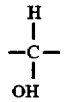

groups are commonly referred to as the glycol groups. The carbon-to-carbon bond between the glycol groups is replaced in the following manner:

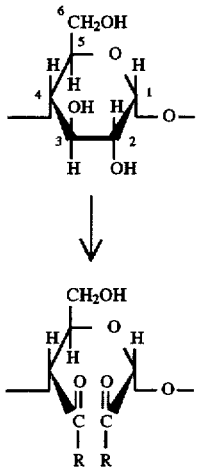

(II)

where R represents the atoms completing an aldehyde group or a carboxyl group.

The hypochlorite oxidation of starch is most extensively employed in commercial use. The hypochlorite is used in small quantities (<0.1% by weight chlorine, based on total starch) to modify impurities in starch, most notably to bleach colored impurities. Any modification of the starch at these low levels is minimal, at most affecting only the polymer chain terminating aldehyde groups, rather than the α-D-glucopyranose repeating units themselves. At levels of oxidation that affect the α-D-glucopyranose repeating units the hypochlorite affects the 2, 3 and 6 positions, forming aldehyde groups at lower levels of oxidation and carboxyl groups at higher levels of oxidation. Oxidation is conducted at mildly acidic or alkaline pH (e.g., >5 to 11). The oxidation reaction is exothermic, requiring cooling of the reaction mixture. Temperatures of less than 45° C. are preferably maintained. Using a hypobromite oxidizing agent is known to produce similar results as hypochlorite.

Hypochlorite oxidation is catalyzed by the presence of bromide ions. Since silver halide emulsions are conventionally precipitated in the presence of a stoichiometric excess of the halide to avoid inadvertent silver ion reduction (fogging), it is conventional practice to have bromide ions in the dispersing media of high bromide silver halide emulsions. Thus, it is specifically contemplated to add bromide ion to the starch prior to performing the oxidation step in the concentrations known to be useful in the precipitation of silver halide emulsions.

Cescato U.S. Pat. No. 3,706,584, the disclosure of which is here incorporated by reference, discloses techniques for the hypochlorite oxidation of cationic starch. Sodium bromite, sodium chlorite and calcium hypochlorite are named as alternatives to sodium hypochlorite. Further teachings of the hypochlorite oxidation of starches is provided by the following: R. L. Whistler, E. G. Linke and S. Kazeniac, "Action of Alkaline Hypochlorite on Corn Starch Amylose and Methyl 4-O-Methyl-D-glucopyranosides", *Journal Amer. Chem. Soc.*, Vol. 78, pp. 4704–9 (1956); R. L. Whistler and R. Schweiger, "Oxidation of Amylopectin with Hypochlorite at Different Hydrogen Ion Concentrations, *Journal Amer. Chem. Soc.*, Vol. 79, pp. 6460–6464 (1957); J. Schmorak, D. Mejzler and M. Lewin, "A Kinetic Study of the Mild Oxidation of Wheat Starch by Sodium Hypochloride in the Alkaline pH Range", *Journal of Polymer Science*, Vol. XLIX, pp. 203–216 (1961); J. Schmorak and M. Lewin, "The Chemical and Physico-chemical Properties of Wheat Starch with Alkaline Sodium Hypochlorite", *Journal of Polymer Science: Part A,* Vol. 1, pp. 2601–2620 (1963); K. F. Patel, H. U. Mehta and H. C. Srivastava, "Kinetics and Mechanism of Oxidation of Starch with Sodium Hypochlorite", *Journal of Applied Polymer Science,* Vol. 18, pp. 389–399 (1974); R. L. Whistler, J. N. Bemiller and E. F. Paschall, *Starch: Chemistry and Technology,* Chapter X, Starch Derivatives: Production and Uses, II. Hypochlorite-Oxidized Starches, pp. 315–323, Academic Press, 1984; and O. B. Wurzburg, *Modified Starches: Properties and Uses,* III. Oxidized or Hypochlorite-Modified Starches, pp. 23–28 and pp. 245–246, CRC Press (1986). Although hypochlorite oxidation is normally carried out using a soluble salt, the free acid can alternatively be employed, as illustrated by M. E. McKillican and C. B. Purves, "Estimation of Carboxyl, Aldehyde and Ketone Groups in Hypochlorous Acid Oxystarches", *Can. J. Chem.,* Vol. 312–321 (1954).

Periodate oxidizing agents are of particular interest, since they are known to be highly selective. The periodate oxidizing agents produce starch dialdehydes by the reaction shown in the formula (II) above without significant oxidation at the site of the 6 position carbon atom. Unlike hypochlorite oxidation, periodate oxidation does not produce carboxyl groups and does not produce oxidation at the 6 position. Mehltretter U.S. Pat. No. 3,251,826, the disclosure of which is here incorporated by reference, discloses the use of periodic acid to produce a starch dialdehyde which is subsequently modified to a cationic form. Mehltretter also discloses for use as oxidizing agents the soluble salts of periodic acid and chlorine. Further teachings of the periodate oxidation of starches is provided by the following: V. C. Barry and P. W. D. Mitchell, "Properties of Periodate-oxidised Polysaccharides. Part II. The Structure of some Nitrogen-containing Polymers", *Journal Amer. Chem. Soc.,* 1953, pp. 3631–3635; P. J. Borchert and J. Mirza, "Cationic Dispersions of Dialdehyde Starch I. Theory and Preparation", *Tappi,* Vol. 47, No. 9, pp. 525–528 (1964); J. E. McCormick, "Properties of Periodate-oxidised Polysaccharides. Part VII. The Structure of Nitrogen-containing Derivatives as deduced from a Study of Monosaccharide Analogues", *Journal Amer. Chem. Soc.,* pp. 2121–2127 (1966); and O. B. Wurzburg, *Modified Starches: Properties and Uses,* III. Oxidized or Hypochlorite-Modified Starches, pp. 28–29, CRC Press (1986).

Starch oxidation by electrolysis is disclosed by F. F. Farley and R. M. Hixon, "Oxidation of Raw Starch Granules by Electrolysis in Alkaline Sodium Chloride Solution", *Ind. Eng. Chem.,* Vol. 34, pp. 677–681 (1942).

Depending upon the choice of oxidizing agents employed, one or more soluble salts may be released during the oxidation step. Where the soluble salts correspond to or are similar to those conventionally present during silver halide precipitation, the soluble salts need not be separated from the oxidized starch prior to silver halide precipitation. It is, of course, possible to separate soluble salts from the oxidized cationic starch prior to precipitation using any conventional separation technique. For example, removal of halide ion in excess of that desired to be present during grain precipitation can be undertaken. Simply decanting solute and dissolved salts from oxidized cationic starch particles is a simple alternative. Washing under conditions that do not solubilize the oxidized cationic starch is another preferred option. Even if the oxidized cationic starch is dispersed in a solute during oxidation, it can be separated using conventional ultrafiltration techniques, since there is a large molecular size separation between the oxidized cationic starch and soluble salt by-products of oxidation.

The carboxyl groups formed by oxidation take the form —C(O)OH, but, if desired, the carboxyl groups can, by further treatment, take the form —C(O)OR', where R' represents the atoms forming a salt or ester. Any organic moiety added by esterification preferably contains from 1 to 6 carbon atoms and optimally from 1 to 3 carbon atoms.

The minimum degree of oxidation contemplated is that required to reduce the viscosity of the starch. It is generally accepted (see citations above) that opening an α-D-glucopyranose ring in a starch molecule disrupts the helical configuration of the linear chain of repeating units which in turn reduces viscosity in solution. It is contemplated that at least one α-D-glucopyranose repeating unit per starch polymer, on average, be ring opened in the oxidation process. As few as two or three opened α-D-glucopyranose rings per polymer has a profound effect on the ability of the starch polymer to maintain a linear helical configuration. It is generally preferred that at least 1 percent of the glucopyranose rings be opened by oxidation.

A preferred objective is to reduce the viscosity of the cationic starch by oxidation to less than four times (400 percent of) the viscosity of water at the starch concentrations employed in silver halide precipitation. Although this viscosity reduction objective can be achieved with much lower levels of oxidation, starch oxidations of up to 90 percent of the α-D-glucopyranose repeating units have been reported (Wurzburg, cited above, p. 29). However, it is generally preferred to avoid driving oxidation beyond levels required for viscosity reduction, since excessive oxidation results in increased chain cleavage. A typical convenient range of oxidation ring-opens from 3 to 50 percent of the α-D-glucopyranose rings.

The water dispersible cationic starch is present during the precipitation (during nucleation and grain growth or during grain growth) of the high bromide {111} tabular grains. Preferably precipitation is conducted by substituting the water dispersible cationic starch for all conventional gelatino-peptizers. In substituting the selected cationic starch peptizer for conventional gelatino-peptizers, the concentrations of the selected peptizer and the point or points of addition can correspond to those employed using gelatino-peptizers.

In addition, it has been unexpectedly discovered that emulsion precipitation can tolerate even higher concentrations of the selected peptizer. For example, it has been observed that all of the selected peptizer required for the preparation of an emulsion through the step of chemical sensitization can be present in the reaction vessel prior to grain nucleation. This has the advantage that no peptizer additions need be interjected after tabular grain precipitation has commenced. It is generally preferred that from 1 to 500 grams (most preferably from 5 to 100 grams) of the selected peptizer per mole of silver to be precipitated be present in the reaction vessel prior to tabular grain nucleation.

At the other extreme, it is, of course, well known, as illustrated by Mignot U.S. Pat. No. 4,334,012, here incorporated by reference, that no peptizer is required to be present during grain nucleation, and, if desired, addition of the selected peptizer can be deferred until grain growth has progressed to the point that peptizer is actually required to avoid tabular grain agglomeration.

The procedures for high bromide {111} tabular grain emulsion preparation through the completion of tabular grain growth require only the substitution of the selected peptizer for conventional gelatino-peptizers. The following high bromide {111} tabular grain emulsion precipitation procedures, here incorporated by reference, are specifically contemplated to be useful in the practice of the invention, subject to the selected peptizer modifications discussed above:

Daubendiek et al U.S. Pat. No. 4,414,310;
Abbott et al U.S. Pat. No. 4,425,426;
Wilgus et al U.S. Pat. No. 4,434,226;
Maskasky U.S. Pat. No. 4,435,501;
Kofron et al U.S. Pat. No. 4,439,520;
Solberg et al U.S. Pat. No. 4,433,048;
Evans et al U.S. Pat. No. 4,504,570;
Yamada et al U.S. Pat. No. 4,647,528;
Daubendiek et at U.S. Pat. No. 4,672,027;
Daubendiek et al U.S. Pat. No. 4,693,964;
Sugimoto et al U.S. Pat. No. 4,665,012;
Daubendiek et al U.S. Pat. No. 4,672,027;
Yamada et al U.S. Pat. No. 4,679,745;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Saitouet al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,210,013;
Antoniades et al U.S. Pat. No. 5,250,403;
Kim et al U.S. Pat. No. 5,272,048;
Delton U.S. Pat. No. 5,310,644;
Chang et al U.S. Pat. No. 5,314,793;
Sutton et al U.S. Pat. No. 5,334,469;
Black et al U.S. Pat. No. 5,334,495;
Chaffee et al U.S. Pat. No. 5,358,840; and
Delton U.S. Pat. No. 5,372,927.

The high bromide {111} tabular grain emulsions that are formed preferably contain greater than 50 mole percent bromide and up to 4 mole percent iodide, based on silver, any remaining halide being chloride. Silver bromide, silver iodobromide, silver chlorobromide, silver iodochlorobromide, and silver chloroiodobromide tabular grain emulsions are specifically contemplated. Chloride is preferably present in concentrations of 30 mole percent or less. Iodide concentrations are limited, since the presence of iodide increases processing times.

The tabular grains in all instances account for greater than 50 percent of total grain projected area and preferably account for the highest proportion of total grain protected area that can be conveniently realized. It is preferred that at least 70 percent, most preferably at least 90 percent, and optimally substantially all (>97 percent) of total grain projected area be accounted for by the high bromide tabular grains.

The high bromide {111} tabular grain emulsions can exhibit mean grain ECD's of any conventional value, ranging up to 10 μm, which is generally accepted as the maximum mean grain size compatible with radiographic imaging. In practice, the tabular grain emulsions of the invention typically exhibit a mean ECD in the range of from about 0.5 to 5.0 μm.

It is generally preferred that the tabular grains exhibit an average thickness of less than 0.3 μm, most preferably less than 0.2 μm. When the emulsions employ gelatin and gelatin-derivative peptizers as binders, a minimum average thickness of the tabular grains compatible with retaining desirably cold image tones is approximately 0.1 μm.

Except for image tone, noted above, the advantages that tabular grains impart to emulsions generally increases as the average aspect ratio or tabularity of the tabular grain emulsions increases. Both aspect ratio (ECD/t) and tabularity ($ECD/t^2$) increase as average tabular grain thickness decreases. Therefore it is generally sought to minimize the thicknesses of the tabular grains to the extent possible for the intended application. Absent specific application prohibitions, it is generally preferred that the tabular grains have an average aspect ratio of greater than 5 and most preferably greater than 8. Tabular grain average aspect ratios can range up to 100 or higher, but are typically in the range of from about 12 to 80. Tabularities of >25 are generally preferred.

Conventional dopants can be incorporated into the tabular grains during their precipitation, as illustrated by the patents cited above and *Research Disclosure,* Item 36544, cited above, Section I. Emulsion grains and their preparation, D. Grain modifying conditions and adjustments, paragraphs (3), (4) and (5). It is specifically contemplated to incorporate shallow electron trapping site providing (SET) dopants in the tabular grains as disclosed in *Research Disclosure,* Vol. 367, November 1994, Item 36736.

It is also recognized that silver salts can be epitaxially grown onto the tabular grains during the precipitation process. Epitaxial deposition onto the edges and/or corners of tabular grains is specifically taught by Maskasky U.S. Pat. No. 4,435,501, cited above and here incorporated by reference. In a specifically preferred form high chloride silver halide epitaxy is present at the edges or, most preferably, restricted to corner adjacent sites on the tabular grains.

Although epitaxy onto the host tabular grains can itself act as a sensitizer, the emulsions of the invention show unexpected sensitivity enhancements with or without epitaxy when chemically sensitized in the absence of gelatin or gelatin derivates, employing one or a combination of noble metal, middle chalcogen and reduction chemical sensitization techniques. Conventional chemical sensitizations by these techniques are summarized in *Research Disclosure,* Item 36544, cited above, Section IV. Chemical sensitizations. All of these sensitizations, except those that specifically require the presence of gelatin (e.g., active gelatin sensitization) are applicable to the practice of the invention. It is preferred to employ at least one of noble metal (typically gold) and middle chalcogen (typically sulfur) and, most preferably, a combination of both in preparing the emulsions of the invention for photographic use.

Between emulsion precipitation and chemical sensitization, the step that is preferably completed before any gelatin or gelatin derivative is added to the emulsion, it is conventional practice to wash the emulsions to remove soluble reaction by-products (e.g., alkali and/or alkaline earth cations and nitrate anions). If desired, emulsion washing can be combined with emulsion precipitation, using ultrafiltration during precipitation as taught by Mignot U.S. Pat. No. 4,334,012. Alternatively emulsion washing by diafiltration after precipitation and before chemical sensitization can be undertaken with a semipermeable membrane as illustrated by *Research Disclosure,* Vol. 102, October 1972, Item 10208, Hagemaier et al *Research Disclosure,* Vol. 131, March 1975, Item 13122, Bonnet *Research*

*Disclosure,* Vol. 135, July 1975, Item 13577, Berg et al German OLS 2,436,461 and Bolton U.S. Pat. No. 2,495,918, or by employing an ion-exchange resin, as illustrated by Maley U.S. Pat. No. 3,782,953 and Noble U.S. Pat. No. 2,827,428. In washing by these techniques there is no possibility of removing the selected peptizers, since ion removal is inherently limited to removing much lower molecular weight solute ions.

A specifically preferred approach to chemical sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen sensitizers are tetrasubstituted middle chalcogen ureas of the type disclosed by Herz et al U.S. Pat. Nos. 4,749,646 and 4,810,626, the disclosures of which are here incorporated by reference. Preferred compounds include those represented by the formula:

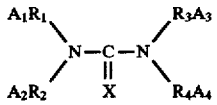

(III)

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carborymethyl, where the carboxy group can be in the acid or salt form. A specifically preferred tetrasubstituted thiourea sensitizer is 1,3-dicarboxymethyl-1,3-dimethylthiourea.

Preferred gold sensitizers are the gold(I) compounds disclosed by Deaton U.S. Pat. No. 5,049,485, the disclosure of which is here incorporated by reference. These compounds include those represented by the formula:

$AuL_2^+X^-$ or $AuL(L^1)^+X^-$ (IV)

wherein

L is a mesoionic compound;

X is an anion; and $L^1$ is a Lewis acid donor.

In another preferred form of the invention it is contemplated to employ alone or in combination with sulfur sensitizers, such as those formula III, and/or gold sensitizers, such as those of formula IV, reduction sensitizers which are the 2-[N-(2-alkynyl)amino]-meta-chalcoazoles disclosed by Lok et al U.S. Pat. Nos. 4,378,426 and 4,451,557, the disclosures of which are here incorporated by reference.

Preferred 2-[N-(2-alkynyl)amino]-meta-chalcoazoles can be represented by the formula:

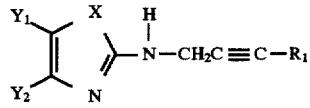

(V)

where

X=O, S, Se;

$R_1$=(Va) hydrogen or (Vb) alkyl or substituted alkyl or aryl or substituted aryl; and $Y_1$ and $Y_2$ individually represent hydrogen, alkyl groups or an aromatic nucleus or together represent the atoms necessary to complete an aromatic or alicyclic ring containing atoms selected from among carbon, oxygen, selenium, and nitrogen atoms.

The formula V compounds are generally effective (with the Vb form giving very large speed gains and exceptional latent image stability) when present during the heating step (finish) that results in chemical sensitization.

Spectral sensitization of the emulsions of the invention is contemplated, even when photographic use of the emulsion is undertaken in a spectral region in which the tabular grains exhibit significant native sensitivity. The adsorbed spectral sensitizing dye significantly reduces crossover. Further, the highest attainable imaging efficiencies are realized when preferred green emitting intensifying screens are employed in combination with spectral sensitizing dyes having peak absorptions corresponding to the peak emission bands of the intensifying screens. While spectral sensitization is most commonly undertaken after chemical sensitization, spectral sensitizing dye can be advantageous introduced earlier, up to and including prior to grain nucleation. Kofron et al U.S. Pat. No. 4,439,520 discloses advantages for "dye in the finish" sensitizations, which are those that introduce the spectral sensitizing dye into the emulsion prior to the heating step (finish) that results in chemical sensitization. Maskasky U.S. Pat. No. 4,435,501 teaches the use of aggregating spectral sensitizing dyes, particularly green and red absorbing cyanine dyes, as site directors for epitaxial deposition. These dyes are present in the emulsion prior to the chemical sensitizing finishing step. When the spectral sensitizing dye present in the finish is not relied upon as a site director for the silver salt epitaxy, a much broader range of spectral sensitizing dyes is available. The spectral sensitizing dyes disclosed by Kofron et al, particularly the blue spectral sensitizing dyes shown by structure and their longer methine chain analogous that exhibit absorption maxima in the green and red portions of the spectrum, are particularly preferred for incorporation in the tabular grain emulsions of the invention. A more general summary of useful spectral sensitizing dyes is provided by *Research Disclosure,* Item 36544, cited above, Section V. Spectral sensitization and desensitization.

While in specifically preferred forms of the invention the spectral sensitizing dye can act also as a site director and/or can be present during the finish, the only required function that a spectral sensitizing dye must perform in the emulsions of the invention is to increase the sensitivity of the emulsion to at least one region of the spectrum. Hence, the spectral sensitizing dye can, if desired, be added to an emulsion according to the invention after chemical sensitization has been completed.

At any time following chemical sensitization and prior to coating additional vehicle is added to the emulsions of the invention. Conventional vehicles and related emulsion components are illustrated by *Research Disclosure,* Item 36544, cited above, Section II. Vehicles, vehicle extenders, vehicle-like addenda and vehicle related addenda. Hydrophilic colloid binders for the protective overcoat and crossover reducing layers can also be chosen from these conventional vehicles. The layers can be hardened to facilitate rapid processing using conventional techniques. When the cationic starch is present only as a peptizer in the emulsion layers, its concentration is too low to have any influence on hardening. Conventional hardeners are illustrated by *Research Disclosure,* Item 36544, cited above, Section II. B. Hardeners. When starch is employed as a binder, acceptably cold image tone can be realized at tabular grain average thicknesses well below 0.1 μm, and it is specifically contemplated to employ starch as a binder with ultrathin tabular grain emulsions—that is, emulsion in which the average thickness of the tabular grains is less than 0.07 μm.

It has been discovered that the replacement of gelatin and gelatin derivative used as binder in the emulsion layers with starch improves the radiographic elements by shifting the developed silver images toward colder (preferred) image tones. The same cationic starches noted above for use as peptizers can be employed also as the binder of the emulsion layers and, for convenience, in the other hydrophilic colloid layers as well, if desired. However, the achievement of colder image tones does not require that the starch be cationic.

When starch is employed as a binder, it can be hardened with conventional starch crosslinking agents. One of the most widely employed crosslinking agents for starch is epichlorohydrin. Other known crosslinking agents include β,β'-dichlorodiethyl ether; dibasic organic acids reacted under conditions such that both carboxyl groups esterify starch hydroxyl groups; phosphorus oxychloride; trimetaphosphate; mixed anhydrides of acetic and di- or tri-basic carboxylic acids; vinyl sulfone; diepoxides; cyanuric chloride; hexahydro-1,3,5-trisacryloyl-s-triazine; hexamethylene diisocyante; toluene 2,4-diisocyanate; N,N-dimethylene-bisacrylamide; N,N'-bis(hydroxymethyl) ethyleneurea; phosgene; tripolyphosphate; mixed carbonic-carboxylic acid anhydrides; imidazolides of carbonic and polybasic carboxylic acids; imidazolium salts of polybasic carboxylic acids; guanidine derivatives of polycarboxylic acids; esters of propynoic acid; and aldehydes (e.g., formaldehyde, acetaldehyde and acrolein). The use of these and similar crosslinking agents are disclosed in Rowland et al U.S. Pat. No. 2,113,034; Felton et al U.S. Pat. No. 2,328,537; Pierson U.S. Pat. No. 2,417,611; Caldwell U.S. Pat. No. 2,461,139; Fenn U.S. Pat. No. 2,469,957; Schoene et al U.S. Pat. No. 2,524,400; Caldwell et al U.S. Pat. No. 2,626,257; Kerr et al U.S. Pat. Nos. 2,438,855, 2,801,242, 2,852,393 and 2,938,901; Hofreiter et al U.S. Pat. No. 2,929,811, Senti et al U.S. Pat. No. 2,989,521; Commerford et al U.S. Pat. No. 2,977,356; Gerwitz U.S. Pat. No. 2,805,220; Wimmer U.S. Pat. No. 2,910,467; Trimmell et al U.S. Pat. Nos. 3,035,045 and 3,086,971; Sowell et al U.S. Pat. No. 3,001,985; Smith et al U.S. Pat. No. 3,069,410; Jarowenko et al U.S. Pat. No. 3,376,287; Speakman U.S. Pat. Nos. 3,549,618 and 3,705,046; Jarowenko U.S. Pat. No. 3,553,195; Tesslet et al U.S. Pat. Nos. 3,699,095 and 3,728,332; and Tessler U.S. Pat. Nos. 4,020,272 and 4,098,997; the disclosures of which are here incorporated by reference. The use of the class of hardeners having two or more active olefin groups, a preferred hardener class also for gelatin and gelatin derivatives, is demonstrated in the Examples below.

Except for the starch substitutions noted above, the radiographic elements of the invention can take any convenient conventional form. The following disclosures of conventional radiographic element constructions are here incorporated by reference:

| | |
|---|---|
| RE-1 | Dickerson U.S. Pat. No. 4,414,304 |
| RE-2 | Abbott et al U.S. Pat. No. 4,425,425 |
| RE-3 | Abbott et al U.S. Pat. No. 4,425,426 |
| RE-4 | Kelly et al U.S. Pat. No. 4,803,150 |
| RE-5 | Kelly et al U.S. Pat. No. 4,900,652 |
| RE-6 | Dickerson et al U.S. Pat. No. 4,994,355 |
| RE-7 | Dickerson et al U.S. Pat. No. 4,997,750 |
| RE-8 | Bunch et al U.S. Pat. No. 5,021,327 |
| RE-9 | Childers et al U.S. Pat. No. 5,041,364 |
| RE-10 | Dickerson et al U.S. Pat. No. 5,108,881 |
| RE-10 | Tsaur et al U.S. Pat. No. 5,252,442 |
| RE-11 | Dickerson et al U.S. Pat. No. 5,252,443 |
| RE-12 | Steklenski et al U.S. Pat. No. 5,259,016 |
| RE-13 | Dickerson U.S. Pat. No. 5,391,469 |

A summary of conventional radiographic element components can also be found in *Research Disclosure,* Vol. 184, August 1979, Item 18431, including particularly:

I. Emulsion stabilizers, Antifoggants and Antikinking Agents

III. Antistatic Agents/Layers

IV. Overcoat Layers

V. Cross-Over Exposure Control

IX. X-Ray Screens/Phosphors

X. Spectral Sensitization

XII. Film Supports.

The following summaries of photographic element features appearing in *Research Disclosure,* Item 36544, previously cited, are also applicable to radiographic element constructions:

V. Spectral sensitization and desensitization
  A. Sensitizing dyes

VII. Antifoggants and stabilizers

IX. Coating physical property modifying addenda
  A. Coating aids
  B. Plasticizers and Lubricants
  C. Antistats
  D. Matting agents

EXAMPLES

The invention can be better appreciated by reference to the following specific examples. Except as otherwise indicated all weight percentages (wt %) are based on total weight.

EXAMPLES 1 THROUGH 17

These examples demonstrate the precipitation of tabular grain emulsions using a cationic starch derived from different plant sources, including a variety of potato and grain sources. The starches were selected to demonstrate a wide range of nitrogen and phosphorus contents. Variations in emulsion precipitation conditions are also demonstrated. Particularly significant is the demonstration that all of the cationic starch used for the entire precipitation can be added prior to grain nucleation.

EXAMPLE 1

AgIBr (3 mole % I) Tabular Grain Emulsion Made Using a Cationic Potato Starch A starch solution was prepared by boiling for 30 min a stirred mixture of 80 g cationic potato starch (STA-LOK®

400, obtained from A. E. Staley Manufacturing Co., Decatur, Ill.), 27 mmoles of NaBr, and distilled water to 4 L. The cationic starch was a mixture of 21% amylose and 79% amylopectin and contained 0.33 wt % nitrogen in the form of a quaternary trimethyl ammonium alkyl starch ether and 0.13 wt % natural phosphorus. The cationic starch had an average molecular weight is 2.2 million. The resulting solution was cooled to 35° C., readjusted to 4 L with distilled water, and the pH was adjusted to 5.5. To a vigorously stirred reaction vessel of the starch solution at 35° C., a 2M $AgNO_3$ solution was added at 100 mL per min for 0.2 min. Concurrently, a salt solution of 1.94M NaBr and 0.06M KI was added initially at 100 mL per min and then at a rate needed to maintain a pBr of 2.21. Then the addition of the solutions was stopped, 25 mL of 2M NaBr solution was added rapidly and the temperature of the contents of the reaction vessel was increased to 60° C. at a rate of 5° C. per 3 min. At 60° C., the $AgNO_3$ solution was added at 10 mL per min for 1 min then its addition rate was accelerated to 50 mL per min in 30 min until a total of 1.00 L had been added. The salt solution was concurrently added at a rate needed to maintain a constant pBr of 1.76. The resulting tabular grain emulsion was washed by diafiltration at 40° C. to a pBr of 3.38.

The tabular grain population of the resulting tabular grain emulsion was comprised of tabular grains with an average equivalent circular diameter of 1.2 μm, an average thickness of 0.06 μm, and an average aspect ratio of 20. The tabular grain population made up 92% of the total projected area of the emulsion grains. The emulsion grains had a coefficient of variation in diameter of 18%.

EXAMPLE 2

AgIBr (3 mole % I) Tabular Grain Emulsion Made Using a Cationic Corn Starch

A starch solution was prepared by boiling for 30 min a stirred 400 g aqueous mixture containing 2.7 mmoles of NaBr and 8.0 g of a cationic hybrid corn starch (CATO® 235, obtained from National Starch and Chemical Company, Bridgewater, N.J.) containing 0.31 wt % nitrogen and 0.00 wt % phosphorus.

The resulting solution was cooled to 35° C., readjusted to 400 g with distilled water. To a vigorously stirred reaction vessel of the starch solution at 35° C., pH 5.5 was added 2M $AgNO_3$ solution at a constant rate of 10 mL per min. Concurrently, a salt solution of 1.94M NaBr and 0.06M KI was added initially at 10 mL per min and then at a rate needed to maintain a pBr of 2.21. After 0.2 min., the addition of the solutions was stopped, 2.5 mL of 2M NaBr was added rapidly, and the temperature of the contents of the reaction vessel was increased to 60° C. at a rate of 5° C. per 3 min. At 60° C., the $AgNO_3$ solution was added at 1.0 mL per min for 1 min then its addition rate was accelerated to reach a flow rate of 5 mL per min in 30 min until a total of 100 mL of the $AgNO_3$ solution had been added. The salt solution was concurrently added at a rate needed to maintain a constant pBr of 1.76.

The tabular grain population of the resulting emulsion was comprised of tabular grains with an average equivalent circular diameter of 1.6 μm, an average thickness of 0.06 μm, and an average aspect ratio of 27. The tabular grain population made up 85% of the total projected area of the emulsion grains.

EXAMPLE 3

AgIBr (3 mole % I) Tabular Grain Emulsion Made Using a Cationic Amphoteric Potato Starch This emulsion was prepared similarly to Example 2, except that the starch used was a cationic amphoteric potato starch (Wespol A®, obtained from Western Polymer Corporation, Moses Lake, Wash.) containing both a quaternary trimethyl ammonium alkyl starch ether, 0.36 wt % nitrogen, and orthophosphate (0.70 wt % phosphorus) substituents.

The tabular grain population of the resulting emulsion was comprised of tabular grains with an average equivalent circular diameter of 1.7 μm, an average thickness of 0.05 μm, and an average aspect ratio of 34. The tabular grain population made up 95% of the total projected area of the emulsion grains.

EXAMPLE 4

AgIBr (3 mole % I) Tabular Grain Emulsion Made Using a Cationic Amphoteric Potato Starch This emulsion was prepared similarly to Example 3, except that the precipitation was stopped after 50 mL of the $AgNO_3$ solution was added.

The tabular grain population of the resulting emulsion was comprised of tabular grains with an average equivalent circular diameter of 1.0 μm, an average thickness of 0.045 μm, and an average aspect ratio of 25. The tabular grain population made up 95% of the total projected area of the emulsion grains.

EXAMPLE 5

AgIBr (3 mole % I) Tabular Grain Emulsion Made Using a Cationic Potato Starch and at pH 2.0

This emulsion was prepared similarly to Example 2, except that the emulsion was precipitated at pH 2.0 and the starch used was cationic potato starch (STA-LOK® 400).

The tabular grain population of the resulting emulsion was comprised of tabular grains with an average equivalent circular diameter of 1.5 μm, an average thickness of 0.06 μm, and an average aspect ratio of 22. The tabular grain population made up 80% of the total projected area of the emulsion grains.

EXAMPLE 6

AgIBr (3 mole % I) Tabular Grain Emulsion Made Using a Cationic Corn Starch

This emulsion was prepared similarly to Example 2, except that the emulsion was precipitated at pH 6.0, and the starch used was a cationic waxy corn starch (STA-LOK® 180, obtained from A. E. Staley Manufacturing Co.) made up of 100% amylopectin derivatized to contain 0.36 wt % nitrogen in the form of a quaternary trimethyl ammonium alkyl starch ether and 0.06 wt % phosphorus, average molecular weight 324,000.

The tabular grain population of the resulting emulsion was comprised of tabular grains with an average equivalent circular diameter of 1.6 μm, an average thickness of 0.06 μm, and an average aspect ratio of 27. The tabular grain population made up 91% of the total projected area of the emulsion grains.

EXAMPLE 7

AgBr Tabular Grain Emulsion Made by Adding 94% of a Cationic Potato Starch After Grain Nucleation A starch solution was prepared by boiling for 30 min a stirred 200 g aqueous mixture containing 3.75 mmoles of NaBr and 8.0 g of the cationic potato starch STA-LOK® 400.

To a vigorously stirred reaction vessel of 12.5 g of the starch solution (0.5 g starch), 387.5 g distilled water, and 2.2 mmole of NaBr at pH of 6.0 and 35° C. was added 2M $AgNO_3$ solution at a constant rate of 10 mL per min. Concurrently, a 2.5M NaBr solution was added initially at 10 mL per min and then at a rate needed to maintain a pBr of 2.21. After 0.2 min, the addition of the solutions was stopped, 2.5 mL of 2M NaBr was added rapidly, and the temperature of the contents of the reaction vessel was increased to 60° C. at a rate of 5° C. per 3 min. At 60° C., 187.5 g of the starch solution (7.5 g starch) was added, the pH was adjusted to 6.0 and maintained at this value throughout the remainder of the precipitation, and the $AgNO_3$ solution was added at 1.0 mL per min for 3 min and the NaBr solution was concurrently added at a rate needed to maintain a pBr of 1.76. Then the addition of the NaBr solution was stopped but the addition of the $AgNO_3$ solution was continued at 1.0 mL per min until a pBr of 2.00 was obtained. Then the addition of the $AgNO_3$ was accelerated at 0.05 mL per min squared and the NaBr solution was added as needed to maintain a pBr of 2.00 until a total of 0.20 mole of silver had been added.

The tabular grain population of the resulting emulsion was comprised of tabular grains with an average equivalent circular diameter of 1.0 μm, an average thickness of 0.055 μm, and an average aspect ratio of 18. The tabular grain population made up 90% of the total projected area of the emulsion grains.

EXAMPLE 8

AgIBr (3 mole % I) Tabular Grain Emulsion Made Using a Cationic Amphoteric Corn Starch This emulsion was prepared similarly to Example 2, except that the starch used was a cationic amphoteric corn starch (STA-LOK® 356, obtained from A. E. Staley Manufacturing Co.) containing both a quaternary trimethyl ammonium alkyl starch ether (0.34 wt % nitrogen) and orthophosphate (1.15 wt % phosphorus) substituents. The cationic amphoteric starch was a mixture of 28% amylose and 72% amylopectin, with an average molecular weight of 486,000.

The tabular grain population of the resulting emulsion was comprised of tabular grains with an average equivalent circular diameter of 1.6 μm, an average thickness of 0.07 μm, and an average aspect ratio of 23. The tabular grain population made up 80% of the total projected area of the emulsion grains.

EXAMPLE 9

AgBr Tabular Grain Emulsion Made Using a Cationic Potato Starch

To a vigorously stirred reaction vessel containing 400 g of a solution at 35° C., pH 6.0 of 8.0 g cationic potato starch (STA-LOK® 400) and 6.75 mmolar in NaBr was added a 2M $AgNO_3$ solution at a rate of 10 mL per min. Concurrently, a 2M NaBr solution was added initially at 10 mL per min and then at a rate needed to maintain a pBr of 2.21. After 0.2 min., the addition of the solutions was stopped, 2.5 mL of 2M NaBr was added rapidly and the temperature was increased to 60° C. at a rate of 5° C. per 3 min. At 60° C., the $AgNO_3$ solution was added at 1.0 mL per min for 1 min then its addition rate was accelerated to 5 mL per min in 30 min then held at this rate until a total of 200 mL of the $AgNO_3$ solution had been added. The salt solution was concurrently added at a rate needed to maintain a constant pBr of 1.76.

The tabular grain population of the resulting emulsion was comprised of tabular grains with an average equivalent circular diameter of 2.2 μm, an average thickness of 0.08 μm, and an average aspect ratio of 28. The tabular grain population made up 85% of the total projected area of the emulsion grains.

EXAMPLE 10

AgIBr (3 mole % I) Tabular Grain Emulsion Made Using a Protonated Tertiary Aminoalkyl (Cationic) Corn Starch This emulsion was prepared similarly to Example 2, except that the starch used was a corn starch (CATO-SIZE® 69, obtained from National Starch and Chemical Co.) that, as obtained, was derivatized to contain tertiary aminoalkyl starch ethers, 0.25 wt % nitrogen, 0.06 wt % phosphorus. At a pH of 5.5, the tertiary amino groups were protonated to render the starch cationic.

The tabular grain population of the resulting emulsion was comprised of tabular grains with an average equivalent circular diameter of 1.2 μm, an average thickness of 0.08 μm, and an average aspect ratio of 15. The tabular grain population made up 55% of the total projected area of the emulsion grains.

EXAMPLE 11

AgIBr (3 mole % I) Tabular Grain Emulsion Made Using a Cationic Potato Starch and at pH 5.5 and 80° C.

This emulsion was prepared similarly to Example 2, except that the starch used was cationic potato starch (STA-LOK® 400) and the temperature was increased to 80° C. (instead of 60° C.).

The tabular grain population of the emulsion was comprised of tabular grains with an average equivalent circular diameter of 1.7 μm, an average thickness of 0.07 μm, and an average aspect ratio of 24. The tabular grain population made up 80% of the total projected area of the emulsion grains.

EXAMPLE 12

AgIBr (3 mole % I) Tabular Grain Emulsion Made Using a Cationic Corn Starch

This emulsion was prepared similarly to Example 2, except that the starch used was a cationic corn starch (CATO® 25, obtained from National Starch and Chemical Company) containing 0.26 wt % nitrogen and 0.00 wt % phosphorous.

The tabular grain population of the resulting emulsion was comprised of tabular grains with an average equivalent circular diameter of 1.2 μm, an average thickness of 0.07 μm, and an average aspect ratio of 17. The tabular grain population made up 65% of the total projected area of the emulsion grains.

EXAMPLE 13

AgIBr (3 mole % I) Tabular Grain Emulsion Made Using a Cationic Corn Starch

This emulsion was prepared similarly to Example 2, except that the starch used was a cationic corn starch (Clinton 788®, obtained from ADM Corn Processing, Clinton, Iowa) containing 0.15 wt % nitrogen and 0.00 wt % phosphorus.

The tabular grain population of the resulting emulsion was comprised of tabular grains with an average equivalent circular diameter of 1.0 μm, an average thickness of 0.08 μm, and an average aspect ratio of 13. The tabular grain population made up 60% of the total projected area of the emulsion grains.

EXAMPLE 14

AgIBr (3 mole % I) Tabular Grain Emulsion Made Using a Cationic Wheat Starch This emulsion was prepared similarly to Example 2, except that the starch used was a cationic wheat starch (K-MEGA® 53S, obtained from ADM/Ogilvie, Montreal, Quebec, Canada), which, as received was derivatized with a quaternary amine. The degree of substitution is 0.050 corresponding to 0.41 wt % nitrogen. The phosphorus was determined spectrophotometrically to be 0.07 wt %.

The tabular grain population of the resulting emulsion was comprised of tabular grains with an average equivalent circular diameter of 1.5 μm, an average thickness of 0.08 μm, and an average aspect ratio of 19. The tabular grain population made up 85% of the total projected area of the emulsion grains.

EXAMPLE 15

AgBr Tabular Grain Emulsion Made Using a Cationic Potato Starch

A starch solution was prepared by boiling for 30 min a stirred 400 g aqueous mixture containing 2.7 mmoles of NaBr and 8.0 g of the cationic potato starch STA-LOK® 400.

The resulting solution was cooled to 35° C., readjusted to 400 g with distilled water. To a vigorously stirred reaction vessel of the starch solution at 35° C., pH 6.0 was added 2M $AgNO_3$ solution at a constant rate of 10 mL per min. Concurrently, a 2M NaBr solution was added initially at 10 mL per min and then at a rate needed to maintain a pBr of 2.21. After 0.2 min., the addition of the solutions was stopped, 2.5 mL of 2M NaBr was added rapidly, and the temperature of the contents of the reaction vessel was increased to 50° C. at a rate of 5° C. per 3 min. At 50° C., the pH was adjusted to 6.0 and the $AgNO_3$ solution was added at 1.0 mL per min for 1 min, then its addition rate was accelerated to reach a flow rate of 5 mL per min in 30 min and held at this rate until a total of 200 mL of the $AgNO_3$ solution had been added. The salt solution was concurrently added at a rate needed to maintain a constant pBr of 1.76.

The tabular grain population of the resulting emulsion was comprised of tabular grains with an average equivalent circular diameter of 1.2 μm, an average thickness of 0.10 μm, and an average aspect ratio of 12. The tabular grain population made up 70% of the total projected area of the emulsion grains.

EXAMPLE 16

AgIBr (3 mole % I) Tabular Grain Emulsion Made Using a Cationic Potato Starch of High Nitrogen Content A cationic potato starch solution containing a high nitrogen content was supplied by Western Polymer Corporation. The starch was 1.10 wt % in nitrogen and 0.25 wt % in natural phosphorus.

To 40 g of the starch solution, which contained 8 g of starch, was added 360 g distilled water and 2.7 mmoles of NaBr. This solution was placed in a reaction vessel and used to precipitate this emulsion using the procedure described in Example 2.

The tabular grain population of the resulting emulsion was comprised of tabular grains with an average equivalent circular diameter of 1.2 μm, an average thickness of 0.09 μm, and an average aspect ratio of 13. The tabular grain population made up 80% of the total projected area of the emulsion grains.

EXAMPLE 17

AgBr Tabular Grain Emulsion Made Using a Cationic Potato Starch

A starch solution was prepared by boiling for 30 min a stirred 400 g aqueous mixture containing 2.7 mmoles of NaBr and 8.0 g of the cationic potato starch STA-LOK® 400.

The resulting solution was cooled to 35° C., readjusted to 400 g with distilled water. To a vigorously stirred reaction vessel of the starch solution at 35° C., pH 6.0 was added 2M $AgNO_3$ solution at a constant rate of 10 mL per min. Concurrently, a salt solution of 2.5M NaBr was added initially at 10 mL per min and then at a rate needed to maintain a pBr of 2.21. After 0.2 min., the addition of the solutions was stopped, 2.5 mL of 2M NaBr was added rapidly, and the temperature of the contents of the reaction vessel was increased to 60° C. at a rate of 5° C. per 3 min. At 60° C., the pH was adjusted to 6.0 and the $AgNO_3$ solution was added at 1.0 mL per min for 1 min then its addition rate was accelerated to reach a flow rate of 5 mL per min in 30 min and held at this rate until a total of 200 mL of the $AgNO_3$ solution had been added. The salt solution was concurrently added at a rate needed to maintain a constant pBr of 1.76. Then the addition of the NaBr solution was stopped and the flow rate of the $AgNO_3$ solution was dropped to 1 mL per min. When the pBr reached 2.28, the NaBr solution flow was resumed to maintain this pBr. After 60 min of growth at this pBr, the pBr was adjusted to 3.04 and maintained at this value until a total of 0.53 moles of silver had been added.

The tabular grain population of the resulting emulsion was comprised of tabular grains with an average equivalent circular diameter of 2.0 μm, an average thickness of 0.14 μm, and an average aspect ratio of 14. The tabular grain population made up 85% of the total projected area of the emulsion grains.

CONTROL EXAMPLES 18 THROUGH 22

These examples demonstrate tabular grain preparation failures resulting from choosing noncationic starches as peptizers.

CONTROL EXAMPLE 18

AgIBr (3 mole % I) Nontabular Grain Emulsion Made Using a Water-Soluble Carboxylated (Noncationic) Corn Starch This emulsion was prepared similarly to Example 2, except that the starch used was a corn starch (FILMKOTE® 54, obtained from National Starch and Chemical Co.), which, as supplied, was derivatized to contain carboxylate groups. The nitrogen content was natural, 0.06 wt %.

A nontabular grain emulsion resulted.

CONTROL EXAMPLE 19

AgIBr (3 mole % I) Nontabular Grain Emulsion Made Using a Water-Soluble Orthophosphate Derivatized (Noncationic) Potato Starch This emulsion was prepared similarly to Example 2, except that the starch used was an orthophosphate derivatized potato starch 0.03 wt % nitrogen (natural), and orthophosphate substituents, 0.66 wt % phosphorus. The sample was obtained from Western Polymer Corporation.

A nontabular grain emulsion resulted.

CONTROL EXAMPLE 20

AgIBr (3 mole % I) Nontabular Grain Emulsion Made Using a Water-Soluble Hydroxypropyl-substituted Noncationic) Corn Starch This emulsion was prepared similarly to Example 2, except that the starch (STARPOL® 530, was obtained from A. E. Staley Manufacturing Co.) used was a hydroxypropyl-substituted corn starch, 0.06 wt % nitrogen (natural) and 0.12 wt % phosphorus.

A nontabular grain emulsion resulted.

CONTROL EXAMPLE 21

AgIBr (3 mole %) Nontabular Grain Emulsion Made Using a Water-Soluble (Noncationic) Potato Starch This emulsion was prepared similarly to Example 2, except that the starch (Soluble Potato Starch obtained from Sigma Chemical Company, St. Louis, Mo.) used was a treated and purified water soluble potato starch, 0.04 wt % nitrogen and 0.06 wt % phosphorus.

A nontabular grain emulsion resulted.

CONTROL EXAMPLE 22

AgIBr (3 mole % I) Nontabular Grain Emulsion Made Using a Water-Soluble (Noncationic) Wheat Starch This emulsion was prepared similarly to Example 2, except that the starch (Supergel® 1400, obtained from ADM/Ogilvie, Montreal, Quebec, Canada) used was a water soluble noncationic wheat starch.

A nontabular grain emulsion resulted.

CONTROL EXAMPLE 23

AgIBr (3 mole % I) Nontabular Grain Emulsion Made Using the Grain Protein Zein

This example demonstrates to the failure of the grain protein zein to act as a peptizer.

In a stirred reaction vessel, 8.0 g of zein (obtained from Sigma Chemical Co.) in 400 g distilled water containing 27 mmole of NaBr was boiled for 60 min. Most of the zein did not appear to dissolve. The mixture was filtered and the filtrate was used as the starch solution to precipitate silver halide using conditions similar to those used in Example 2.

The resulting precipitation resulted in large clumps of nontabular grains.

CONTROL EXAMPLES 24 THROUGH 27

These examples demonstrate tabular grain preparation failures resulting from choosing noncationic starch-like substances as peptizers.

CONTROL EXAMPLE 24

AgIBr (3 mole % I) Nontabular Grain Emulsion Made Using the Noncationic Polysaccharide Dextran This emulsion was prepared similarly to Example 2, except that the polysaccharide dextran (obtained from Sigma Chemical Co., St. Louis, Mo.), having a molecular weight of approximately 500,000, was employed.

The resulting precipitation resulted in large clumps of nontabular grains. Dextran was unable to peptize the silver halide grains.

CONTROL EXAMPLE 25

AgIBr (3 mole % I) Nontabular Grain Emulsion Made Using the Noncationic Polysaccharide, Agar This emulsion was prepared similarly to Example 2 except that the polysaccharide used was agar (purified, ash content <2%), obtained from Sigma Chemical Co.

The resulting precipitation resulted in large clumps and isolated nontabular grains. Agar was a poor peptizer for silver halide grains.

CONTROL EXAMPLE 26

AgIBr (3 mole % I) Nontabular Grain Emulsion Made Using the Noncationic Polysaccharide Pectin This emulsion was prepared similarly to Example 2, except that the polysaccharide used was pectin from citrus fruit (obtained from Sigma Chemical Co).

A nontabular grain emulsion resulted.

CONTROL EXAMPLE 27

AgIBr (3 mole % I) Nontabular Grain Emulsion Made Using the Noncationic Polysaccharide, Gum Arabic This emulsion was prepared similarly to Example 2, except that the polysaccharide used was gum arabic (obtained from Sigma Chemical Co.), having a molecular weight of about 250,000.

A nontabular grain emulsion resulted.

CONTROL EXAMPLES 28 THROUGH 30

These examples confirm that the experimental conditions demonstrated above to produce tabular grain emulsions with cationic starch worked poorly using gelatin. While gelatin is a well known peptizer for the precipitation of tabular grain emulsions, the choice of adding all of the peptizer before grain nucleation, demonstrated above using cationic starches, hampered tabular grain emulsion preparation.

CONTROL EXAMPLE 28

AgIBr (3 mole % I) Tabular Grain Emulsion Made Using Gelatin as Peptizer

This emulsion was prepared similarly to Example 2, except that oxidized bone gelatin was substituted for the starch.

The tabular grain population of the resulting emulsion was comprised of tabular grains with an average equivalent circular diameter of 2.2 μm, an average thickness of 0.07 μm, and an average aspect ratio of 31. The tabular grain population made up 60% of the total projected area of the emulsion grains, down from 85% in Example 2.

CONTROL EXAMPLE 29

AgIBr (3 mole % I) AgIBr Nontabular Grain Emulsion Made Using Gelatin as Peptizer This emulsion was prepared similarly to Control Example 28, except that precipitation was terminated after the addition of 0.1 mole of silver nitrate.

The tabular grain population of the resulting emulsion was comprised of tabular grains with an average equivalent circular diameter of 2.0 μm, an average thickness of 0.06 μm, and an average aspect ratio of 33. The tabular grain population made up only 30% of the total projected area of the emulsion grains.

CONTROL EXAMPLE 30

AgBr Nontabular Grain Emulsion Made Using Gelatin as Peptizer

This emulsion was prepared similarly to Example 2, except that oxidized bone gelatin was substituted for the starch and the precipitation growth temperature was 60° C., instead of 50° C.

The tabular grain population of the resulting emulsion was comprised of tabular grains with an average equivalent circular diameter of 3.2 μm, an average thickness of 0.07 μm, and an average aspect ratio of 46. The tabular grain population made up only 30% of the total projected area of the emulsion grains.

CONTROL EXAMPLE 31

AgIBr (2.7 mole % I) Tabular Grain Emulsion

This emulsion was prepared in bone gelatin using conventional techniques favorable for the formation of tabular grain emulsions for the purpose of providing an emulsion with tabular grain thicknesses equal to or less than and tabular grain projected areas equal to or greater than those of the tabular grain emulsion precipitated in cationic starch reported in Example 1.

The emulsion was diafiltered-washed to a pBr of 3.38 at 40° C. The tabular grains had an average equivalent circular diameter of 2.45 μm, an average thickness of 0.06 μm, and an average aspect ratio of 41. The tabular grain population made up 95% of the total projected area of the emulsion grains.

TABLE I

| | | | Emulsion Summary | | | |
|---|---|---|---|---|---|---|
| Example (Control) | Peptizer | Cationic | Wt % Nitrogen | Wt % Phosphorus | Tabular Grains Present | Tabular Grains as % of Total Grain Projected Area |
| 1 | Potato Starch | Yes | 0.33 | 0.13[a] | Yes | 92 |
| 2 | Hybrd Corn S. | Yes | 0.31 | 0.00 | Yes | 85 |
| 3 | Potato Starch | Yes | 0.36 | 0.70 | Yes | 95 |
| 4 | Potato Starch | Yes | 0.36 | 0.70 | Yes | 95 |
| 5 | Potato Starch | Yes | 0.33 | 0.13[a] | Yes | 80 |
| 6 | Waxy Corn S. | Yes | 0.36 | 0.06[a] | Yes | 91 |
| 7 | Potato Starch | Yes | 0.33 | 0.13[a] | Yes | 90 |
| 8 | Potato Starch | Yes | 0.34 | 1.15 | Yes | 80 |
| 9 | Potato Starch | Yes | 0.33 | 0.13[a] | Yes | 85 |
| 10 | Corn Starch | Yes | 0.25 | 0.03[a] | Yes | 55 |
| 11 | Potato Starch | Yes | 0.33 | 0.13[a] | Yes | 80 |
| 12 | Corn Starch | Yes | 0.26 | 0.00 | Yes | 65 |
| 13 | Corn Starch | Yes | 0.15 | 0.00 | Yes | 60 |
| 14 | Wheat Starch | Yes | 0.41[b] | 0.07[a] | Yes | 85 |
| 15 | Potato Starch | Yes | 0.33 | 0.13[a] | Yes | 70 |
| 16 | Potato Starch | Yes | 1.10 | 0.25[a] | Yes | 80 |
| 17 | Potato Starch | Yes | 0.33 | 0.13[a] | Yes | 85 |
| (18) | Corn Starch | No | 0.06[a] | 0.00 | No | 0 |
| (19) | Potato Starch | No | 0.03[a] | 0.66 | No | 0 |
| (20) | Corn Starch | No | 0.06[a] | 0.00 | No | 0 |
| (21) | Potato Starch | No | 0.04[a] | 0.06 | No | 0 |
| (22) | Wheat Starch | No | NM | NM | No | 0 |
| (23) | Zein | No | NM | NM | No | 0 |
| (24) | Dextran | No | NM | NM | No | 0 |

TABLE I-continued

| Emulsion Summary | | | | | | |
|---|---|---|---|---|---|---|
| Example (Control) | Peptizer | Cationic | Wt % Nitrogen | Wt % Phosphorus | Tabular Grains Present | Tabular Grains as % of Total Grain Projected Area |
| (25) | Agar | No | NM | NM | No | 0 |
| (26) | Pectin | No | NM | NM | No | 0 |
| (27) | Gum Arabic | No | NM | NM | No | 0 |
| (28) | Gelatin | NA | NA | NA | Yes | 60 |
| (29) | Gelatin | NA | NA | NA | Yes | 30 |
| (30) | Gelatin | NA | NA | NA | Yes | 30 |
| (31) | Gelatin | NA | NA | NA | Yes | 95 |

[a]Natural content
[b]Calculated from the degree of substitution.
NM = Not Measured
NA = Not Applicable

EXAMPLE 32

Sensitometric Comparisons

Four emulsion samples were compared.

The tabular grain emulsion of Example 1, precipitated in the presence of cationic starch, was divided into three portions to form three samples. Two portions received no further treatment until sensitization, "Example 1 STA" and "Example 1 STA-Spectral". The samples were identical, but the latter sample received only spectral sensitization, instead of chemical and spectral sensitization, as in the case of the remaining emulsion samples.

To 0.81 mole of the third portion, "Example 1 GEL", 20 g of bone gelatin in 100 mL distilled water were added. The purpose of adding gelatin was to demonstrate the effect of gelatin added as a vehicle after precipitation and before chemical sensitization, as is conventional practice.

A fourth emulsion sample was taken from a conventional silver iodobromide (2.7 mole % I) tabular grain precipitated in bone gelatin, Control Example 31. The purpose of providing this sample was to compare the properties of an emulsion precipitated in gelatin to the emulsions precipitated in the absence of gelatin and sensitized either in the presence or absence of gelatin.

To 0.035 mole of the emulsion sample (see Table II, below) at 40° C., with stirring, were added sequentially the following solutions containing (mmole/mole Ag); 2.5 of NaSCN, 0.22 of a benzothiazolium salt, 1.5 of anhydro-5, 5-'dichloro-3,3'-bis(3-sulfopropyl)thiacyanine hydroxide, triethylammonium salt, and 0.08 of 1-(3-acetamidophenyl)-5-mercaptotetrazole, sodium salt. The pH was adjusted to 5.9. Then the following solutions were sequentially added (mmole/mole Ag) 0.023 of 2-propargylaminobenzoxazole, 0.036 of 1,3-dicarboxymethyl-1,3-dimethyl-2-thiourea, and 0.014 of bis(1,3,5-trimethyl-1,2,4-triazolium-3-thiolate) gold (i) tetrafluoroborate. The mixture was heated to 55° C. at a rate of 5° C./3 min, and held at 55° C. for 15 min. Upon cooling to 40° C., a solution of 1.68 of 5-bromo-4-hydroxy-6-methyl-1,3,3a,7-tetraazaindene was added. Example 1 STA-Spectral only had the spectral sensitizing dye added.

The resulting sensitized emulsions were mixed with gelatin, yellow dye-forming coupler dispersion, surfactants, and hardener and coated onto clear support at 0.84 g/m$^2$ silver, 1.7 g/m$^2$ yellow dye-forming coupler, and 3.5 g/m$^2$ bone gelatin.

The coatings were exposed to blue light for 0.02 sec through a 0 to 4.0 log density graduated step tablet, processed in the Kodak Flexicolor C-41™ color negative process using a development time of 3 min 15 sec.

The results are summarized in Table II.

TABLE II

| Emulsion Sensatized | $D_{max}$ | $D_{min}$ | Mid-Scale Contrast | Relative Speed at 0.2 above $D_{min}$ |
|---|---|---|---|---|
| Control Example 31 | 3.03 | 0.08 | 2.01 | 100 |
| Example 1 GEL | 2.96 | 0.09 | 1.79 | 115 |
| Example 1 STA | 3.18 | 0.13 | 2.08 | 204 |
| Example 1 STA-Spectral | 0.70 | 0.50 | 1.69 | −11 |

Control Example 31, a conventional tabular grain emulsion in which the grains were precipitated in gelatin, was employed as the speed reference. Example 1 GEL, which was precipitated in cationic starch, but had gelatin added before chemical sensitization, exhibited a speed that was 15 relative speed units faster than the speed of Control Example 31. Thus, Example 1 GEL was 0.15 log E (15 relative speed units=0.15 log E, where E is exposure in lux-seconds) faster than Control Example 31. This amounted to a speed advantage of 0.15 log E (one-half stop). It was unexpected that precipitation in cationic starch as opposed to gelatin would produce this significant speed advantage.

Quite surprising was the large speed advantage demonstrated by Example 1 STA. This emulsion, which precipitated and sensitized in the absence of gelatin, was 1.04 log E faster than Control Example 31. In other words, it was more than 10 times faster than the conventional Control Example 31 emulsion.

Example 1 STA-Spectral was included to demonstrate that the cationic starch itself, apart from the chemical sensitizers, was not imparting the speed observed. Example 1 STA-Spectral was 111 relative speed units (1.11 log E) slower than Control Example 31. From this it was concluded that the cationic starch was in some way permitting better interaction of the chemical sensitizer with the grain surface than is conventionally realized by employing gelatin as a peptizer.

EXAMPLE 33

Testing for Starch Retained after Washing

A coating of Example 1 STA prepared as described in Example 32 was treated with a 0.2 wt % solution of active proteolytic enzyme (H.T.-Proteolytic 200 from Miles Labs, Inc., Elkhart, Ind.) for 30 min at 35° C. to degrade the gelatin. The emulsion grains were washed twice in distilled water and examined by infra-red spectroscopy. The infra-red absorption spectrum of the starch was clearly observed, demonstrating that the starch remained a permanent part of the emulsion and was not removed by washing.

EXAMPLE 34

Peptizer Viscosity Comparisons

CS

A 2 percent by weight cationic starch solution, CS, was prepared by boiling for 30 min a stirred mixture of 8 g STA-LOK® 400, 2.7 mmoles of NaBr and distilled water to 400 mL. The solution was sonicated for 3 min. The resulting solution was cooled to 40° C., readjusted to 400 mL with distilled water, sonicated for 3 min, and the pH adjusted to 6.0.

GEL

A 2 percent by weight gealtin solution, GEL, was prepared using bone gelatin. To 4 L was added 27 mmoles of NaBr and the pH was adjusted to 6.0 at 40° C.

The kinematic viscosities of water and the CS and GEL solutions were measured at various temperatures. The results are given below.

TABLE III

| | Viscosity (cP) | | |
|---|---|---|---|
| | Temperature | | |
| Solution | 40° C. | 20° C. | 11° C. |
| Water | 0.66 | 1.00 | 1.27 |
| CS | 3.55 | 5.71 | 7.39 |
| GEL | 1.67 | X | X |

X = Could not be run because the solution solidified.

The viscosity data show that cationic starch has low viscosity at low temperatures while the gelatin solution solidified. This makes cationic starch particularly useful for silver halide grain nucleation and/or growth at temperatures below 25° C.

EXAMPLES 35 TO 44C

These examples are provided to demonstrate the advantages of oxidized cationic starch used as a peptizer. The suffix "C" is used to identify comparative Examples, which fail to satisfy the requirements of the invention. The acronyms "OCS", "CS" and "GEL" are used to indicate oxidized cationic starch (OCS), nonoxidized cationic starch (CS) and gelatin (GEL).

Preparation of Oxidized Cationic Starch

OCS-1

An oxidized cationic starch solution (OCS-1) was prepared by boiling for 30 min a stirred mixture of 80 g cationic potato starch, 27 mmoles of NaBr and distilled water to 4 L. The starch, STA-LOK® 400, was obtained from A. E. Staley Manufacturing Co., Decatur, Ill., and is a mixture of 21% amylose and 79% amylopectin, 0.33 wgt % nitrogen in the form of a quaternary trimethyl ammonium alkyl starch ether, 0.13 wgt % natural phosphorus, average molecular weight 2.2 million.

The resulting solution was cooled to 40° C., readjusted to 4 L with distilled water, and the pH adjusted to 7.9 with solid $NaHCO_3$ (1.2 g was required). With stirring, 50 mL of a NaOCl solution (containing 5 wgt % chlorine) was added along with dilute $HNO_3$ to maintain the pH between 6.5 to 7.5. Then the pH was adjusted to 7.75 with saturated $NaHCO_3$ solution. The stirred solution was heated at 40° C. for 2 hrs. The solution was adjusted to a pH of 5.5.

Peptizer Viscosity Comparisons

OCS-2

A 2 percent by weight solution of oxidized cationic starch, OCS-2, was prepared as described above, except that the final pH of the solution was adjusted to 6.0 (instead of 5.5).

CS-1

A 2 percent by weight solution of cationic starch, CS-1, was prepared by boiling for 30 min a stirred mixture of 8 g STA-LOK® 400, 2.7 moles of NaBr and distilled water to 400 mL. The resulting solution was cooled to 40° C., readjusted to 400 mL with distilled water, sonicated for 3 min, and the pH adjusted to 6.0.

GEL-1

A 2 percent by weight solution of gelation, GEL-1, was prepared using bone gelatin. To 4 L was added 27 moles of NaBr and the pH was adjusted to 6.0 at 40° C.

The kinematic viscosities of these three solutions were measured at various temperatures. The results are given in Table III below.

TABLE III

| | Viscosity (cP) | | |
|---|---|---|---|
| | Temperature | | |
| Solution | 40° C. | 20° C. | 11° C. |
| Water | 0.66 | 1.00 | 1.27 |
| OCS-2 | 1.02 | 1.72 | 2.06 |
| CS-1 | 3.55 | 5.71 | 7.39 |
| GEL-1 | 1.67 | X | X |

X solution solidified.

The viscosity data show that the oxidized cationic starch has the lowest viscosity at low temperatures (less than about 25° C.). This low viscosity makes it desirable for silver halide grain nucleation and/or growth at temperatures below 25° C.

EXAMPLE 35

AgIBr (3 mole % I) Ultrathin Tabular Grain Emulsion Made Using Oxidized Cationic Starch To a vigorously stirred reaction vessel containing 4 L of the oxidized cationic starch solution (OCS-1) at 35° C., a 2M $AgNO_3$ solution was added at 100 mL per min for 0.2 min. Concurrently, a salt solution of 1.94M NaBr and 0.06M KI was added initially at 100 mL per min and then at a rate needed to maintain a pBr of 2.21. Then the addition of the solutions was stopped, 25 mL of 2M NaBr solution was added rapidly and the temperature of the contents of the reaction vessel was increased to 60° C. at a rate of 5° C. per 3 min. At 60° C., the $AgNO_3$ solution was added at 10 mL per min for 1 min then its addition rate was accelerated to 40 mL per min in 30 min and held at this flow rate until a total of 2 moles of silver had been added. The iodide containing salt solution was concurrently added at a rate needed to maintain a constant pBr of 1.76. The resulting tabular grain emulsion was washed by diafiltration at 40° C. to a pBr of 3.38.

The tabular grains had an average equivalent circular diameter (ECD) of 1.1 μm, an average thickness of 0.05 μm, and an average aspect ratio of 22. The tabular grain population made up 95% of the total projected area of the emulsion grains. The emulsion grains had a coefficient of variation in diameter of 21%.

EXAMPLE 36

AgIBr (3 mole % I) Ultrathin Tabular Grain Emulsion Made Using Oxidized Cationic Starch and a Growth pBr of 2.0

To a vigorously stirred reaction vessel containing 400 g of the oxidized cationic starch solution (OCS-1) at 35° C., pH 6.0 was added 2M $AgNO_3$ solution at a constant rate of 10 mL per min. Concurrently, a salt solution of 1.94M NaBr and 0.06M KI was added initially at 10 mL per min and then at a rate needed to maintain a pBr of 2.21. After 0.2 min., the addition of the solutions was stopped, 2.5 mL of 2M NaBr was added rapidly, and the temperature of the contents of the reaction vessel was increased to 60° C. at a rate of 5° C. per 3 min. The pH was adjusted to 6.0 and maintained at this value during the remainder of the precipitation. At 60° C., the $AgNO_3$ solution was added at 1.0 mL per min and the salt solution was added at a rate needed to maintain a pBr of 1.76. After 3 min of precipitation at this pBr, the flow of the salt solution was stopped until a pBr of 2.00 was reached. The $AgNO_3$ solution flow rate was then accelerated at a rate that would have reached 4 mL per min in 60 min until a total of 0.20 mole of silver had been added. The iodide containing salt solution was added as needed to maintain a pBr of 2.00.

The tabular grain population of the resulting emulsion was comprised of ultrathin tabular grains with an average equivalent circular diameter of 1.7 μm, an average thickness of 0.055 μm, and an average aspect ratio of 31. The tabular grain population made up 95% of the total projected area of the emulsion grains.

EXAMPLE 37

AgIBr (3 mole % I) Ultrathin Tabular Grain Emulsion

This emulsion was prepared similarly to Example 36, except that the precipitation was stopped after a total of 0.10 mole of the $AgNO_3$ solution was added.

The tabular grain population of the resulting emulsion was comprised of ultra-thin tabular grains with an average equivalent circular diameter of 1.2 μm, an average thickness of 0.040 μm, and an average aspect ratio of 30. The tabular grain population made up 95% of the total projected area of the emulsion grains.

EXAMPLE 38

AgIBr (3 mole % I) Ultrathin Tabular Grain Emulsion Made Using Oxidized Cationic Starch and a Growth pBr of 1.5

To a vigorously stirred reaction vessel containing 400 g of the oxidized cationic starch solution (OCS-1) at 35° C., pH 6.0 was added 2M $AgNO_3$ solution at a constant rate of 10 mL per min. Concurrently, a salt solution of 1.94M NaBr and 0.06M KI was added initially at 10 mL per min and then at a rate needed to maintain a pBr of 2.21. After 0.2 min., the addition of the solutions was stopped, 2.5 mL of 2M NaBr was added rapidly, and the temperature of the contents of the reaction vessel was increased to 60° C. at a rate of 5° C. per 3 min. The pH was adjusted to 6.0 and maintained at this value during the remainder of the precipitation. At 60° C., the $AgNO_3$ solution was added at 1.0 mL per min and the salt solution was added at a rate needed to maintain a pBr of 1.76. After 3 min of precipitation at this pBr, the flow of the silver and salt solutions was stopped and 2.75 mL of a 2.0M NaBr solution was added. The $AgNO_3$ solution flow rate was then accelerated at a rate that would have reached 4 mL per min in 60 min until a total of 0.20 mole of silver had been added. The iodide containing salt solution was added as needed to maintain a pBr of 1.5.

The tabular grain population of the resulting emulsion was comprised of ultrathin tabular grains with an average equivalent circular diameter of 3.0 μm, an average thickness of 0.05 μm, and an average aspect ratio of 60. The tabular grain population made up 95% of the total projected area of the emulsion grains.

EXAMPLE 39

AgIBr (3 mole % I) Ultrathin Tabular Grain Emulsion

This emulsion was prepared similarly to Example 38, except that the precipitation was stopped after a total of 0.10 mole of the $AgNO_3$ solution was added.

The tabular grain population of the resulting emulsion was comprised of ultra-thin tabular grains with an average equivalent circular diameter of 1.5 μm, an average thickness of 0.040 μm, and an average aspect ratio of 38. The tabular grain population made up 98% of the total projected area of the emulsion grains.

EXAMPLE 40

AgIBr (3 mole % I) Ultrathin Tabular Grain Emulsion Made Using Oxidized Cationic Starch and Low Temperature Grain Nucleation To a vigorously stirred reaction vessel containing 400 g of the oxidized cationic starch solution (OCS-1) at 13° C. and at pH 6.0 was added 2M $AgNO_3$ solution at a constant rate of 10 mL per min. Concurrently, a salt solution of 1.94M NaBr and 0.06M KI was added initially at 10 mL per min and then at a rate needed to maintain a pBr of 2.21. After 0.2 min., the addition of the solutions was stopped, 2.5 mL of 2M NaBr was added rapidly, and the temperature of the contents of the reaction vessel was increased to 50° C. at a rate of 5° C. per 3 min. The pH was adjusted to 6.0 and maintained at this value during the remainder of the precipitation. At 50° C., the $AgNO_3$ solution was added at 1.0 mL per min and the salt solution was added at a rate needed to maintain a pBr of 1.76. After 3 min of precipitation at this pBr, the $AgNO_3$ solution flow rate was accelerated to 4 mL per min in 60 min and held at this rate until a total of 0.40 mole of silver had been added. The iodide containing salt solution was added as needed to maintain a pBr of 1.76.

The tabular grain population of the resulting ultrathin tabular grain emulsion was comprised of ultra-thin tabular grains with an average equivalent circular diameter of 1.8 μm, an average thickness of 0.06 μm, and an average aspect ratio of 30. The tabular grain population made up 95% of the total projected area of the emulsion grains.

EXAMPLE 41

AgIBr (3 mole % I) Ultrathin Tabular Grain Emulsion Made Using Oxidized Cationic Starch and Low Temperature Grain Nucleation This emulsion was prepared similarly to Example 40, except that the precipitation was stopped after a total of 0.20 mole of silver was added.

The tabular grain population of the resulting emulsion was comprised of ultrathin tabular grains with an average equivalent circular diameter of 1.3 μm, an average thickness of 0.045 μm, and an average aspect ratio of 29. The tabular grain population made up 98% of the total projected area of the emulsion grains.

EXAMPLE 42

AgIBr (3 mole % I) Ultrathin Tabular Grain Emulsion Made Using Oxidized Cationic Starch and Low Temperature Grain Nucleation This emulsion was prepared similarly to Example 40, except that the precipitation was stopped after a total of 0.10 mole of the $AgNO_3$ solution was added.

The tabular grain population of the resulting emulsion was comprised of ultra-thin tabular grains with an average equivalent circular diameter of 1.0 μm, an average thickness of 0.040 μm, and an average aspect ratio of 25. The tabular grain population made up 98% of the total projected area of the emulsion grains.

EXAMPLE 43

AgIBr (3 mole % I) Ultrathin Tabular Grain Emulsion Made Using Oxidized Cationic Starch and Low Temperature Grain Nucleation This emulsion was prepared similarly to Example 40, except that the precipitation was stopped after a total of 0.05 mole of the $AgNO_3$ solution was added.

The average thickness was determined by scanning 195 tabular grains using atomic force microscopy to obtain an average tabular grain plus adsorbed starch thickness. The measured starch thickness of 0.0030 μm (the sum of both sides) was subtracted from this value. The corrected average thickness was 0.034 μm. The area weighted equivalent circular diameter was 0.70 μm. The average aspect ratio was 21. The tabular grain population made up 98% of the total projected area of the emulsion grains.

EXAMPLE 44C

AgIBr (3 mole % I) Attempted Ultrathin Tabular Grain Emulsion Made Using Oxidized Noncationic Starch This emulsion was prepared similarly to Example 38, except that the starch used was soluble potato starch obtained from Sigma Chemical Company, St. Louis, Mo. The starch was oxidized using the same procedure used for the starch of Example 38.

Clumps of 3-dimensional grains resulted. No tabular grains or isolated 3-dimensional grains were observed. This oxidized noncationic starch failed to peptize the silver halide grains at the high bromide ion concentration generally used to make tabular grain emulsions and particularly the bromide ion concentration (pBr=1.5) used to make Example 38.

EXAMPLE 45

Sensitometric Comparisons

The purpose of this example is to demonstrate the effect on photographic performance of varied peptizers and peptizer combinations.

Emulsions were prepared with five different selections of peptizers introduced before chemical sensitization.

GEL ONLY

The Control Example 31 emulsion was employed. Gelatin was the sole peptizer present prior to chemical sensitization.

CS+GEL

The Example 1 emulsion was employed. As precipitated nonoxidized cationic starch (CS) was present. Before chemical sensitization an additional 25 g of bone gelatin per mole of silver was added.

CS ONLY

The Example 1 emulsion was employed. Only nonoxidized cationic starch (CS) was present before chemical sensitization.

OCS+GEL

The Example 35 emulsion prepared using oxidized cationic starch as the peptizer was modified by the addition of 25 g of bone gelatin per mole of silver before chemical sensitization.

OCS ONLY

The Example 35 emulsion was employed. Only oxidized cationic starch (OCS) was present before chemical sensitization.

Chemical Sensitizations

To 0.035 mole of the emulsion sample (see Table IV, below) at 40° C., with stirring, were added sequentially the following solutions containing (mole/mole Ag): 2.5 of NaSCN, 0.22 of a benzothiazolium salt, 1.5 of anhydro-5, 5-'dichloro-3,3'-bis(3-sulfopropyl)thiacyanine hydroxide, triethylammonium salt, and 0.08 of 1-(3-acetamidophenyl) -5-mercaptotetrazole, sodium salt. The pH was adjusted to 5.9. Then varied combinations of the following solutions were sequentially added (mole/mole Ag): 0.023 of 2-propargylaminobenzoxazole (a reduction sensitizer labeled R in Table IV below), 0.036 of 1,3-dicarboxymethyl-1,3-dimethyl-2-thiourea (a sulfur sensitizer labeled S in Table IV below), and 0.014 of bis(1,3,5-trimethyl-1,2,4-triazolium-3-thiolate) gold (I) tetrafluoroborate (a gold sensitizer labeled Au in Table IV below). The mixture was heated to the temperature given in Table IV below at a rate of 5° C. per 3 min, and held at this temperature for 15 min. Upon cooling to 40° C., a solution of 1.68 of 5-bromo-4-hydroxy-6-methyl-1,3,3a,7-tetraazaindene was added.

The resulting blue spectrally and chemically sensitized emulsions were mixed with gelatin, yellow dye-forming coupler dispersion, surfactants, and hardener and coated onto clear support at 0.84 $g/m^2$ silver, 1.7 $g/m^2$ yellow dye-forming coupler, and 3.5 $g/m^2$ bone gelatin.

The coatings were exposed to blue light for 0.02 sec through a 0 to 4.0 log density graduated step tablet, processed in the Kodak Flexicolor C-41™ color negative process using a development time of 3 min 15 sec.

The results are summarized in Table IV. The GEL ONLY sample, S+Au+R sensitized at 55° C., was employed as the speed reference and assigned a relative speed of 100, measured at a density of 0.2 above minimum density (Dmin). Each relative speed unit difference between the relative speed of 100 and the reported relative speed represents 0.01 log E, where E represents exposure in lux-seconds. For instance, CS+GEL required 0.15 log E less exposure to reach the referenced density of 0.2 above Dmin than GEL ONLY.

TABLE IV

Ultrathin Tabular Grain Emulsion Sensitization

| Sample | Sensitizer | Sens. Temp (°C.) | $D_{max}$ | $D_{min}$ | Mid-Scale Contrast | Rel. Speed |
|---|---|---|---|---|---|---|
| GEL ONLY | S + Au + R | 55 | 3.03 | 0.08 | 2.01 | 100 |
| CS + GEL | S + Au + R | 55 | 2.86 | 0.09 | 1.79 | 115 |
| CS + GEL | S + Au + R | 65 | 3.12 | 0.12 | 1.95 | 198 |
| CS ONLY | S + Au | 45 | 1.03 | 0.04 | 1.70 | 12 |
| CS ONLY | S + Au + R | 45 | 1.55 | 0.05 | 1.71 | 46 |
| CS ONLY | S + Au + R | 55 | 3.18 | 0.13 | 2.08 | 204 |
| OCS + GEL | S + Au | 45 | 1.73 | 0.05 | 2.58 | 23 |
| OCS + GEL | S + Au + R | 45 | 1.93 | 0.05 | 2.40 | 37 |
| OCS ONLY | S + Au | 45 | 3.09 | 0.14 | 2.05 | 192 |
| OCS ONLY | S + Au | 50 | 3.13 | 0.21 | 2.01 | 203 |

Table IV shows that, after sensitization, the photographic speed of OCS ONLY, sensitized at relatively low temperatures (45° C. and 50° C.) and without the 2-propargylaminobenzoxazole (R) was far superior to the other emulsions sensitized at similarly low temperatures, even when the propargyl compound (R) was added to boost speed. The presence of gelatin significantly retarded the ability of GEL ONLY, CS+GEL, and OCS+GEL to be effectively sensitized. Only by using higher temperatures for their chemical sensitization did these control emulsions approach the photographic speed of OCS ONLY sensitized at 45° C. and 50° C. OCS ONLY sensitized at 45° C. with S+Au was 1.8 Log E faster than CS ONLY, similarly sensitized. This demonstrates the lower sensitization temperatures that can be employed using an oxidized cationic starch as the sole peptizer.

It was found that sensitizing these ultrathin tabular grains at temperatures above 50° C. significantly thickened the grains. Both OCS and OCS+GEL were employed in the ultrathin tabular grain emulsion of Example 1 above. The average thickness of the ultrathin tabular grains before chemical sensitization was 0.050 μm. A comparison of average ultrathin tabular grain thickness before and after chemical sensitization for 15 minutes at varied temperatures is summarized in Table V below.

TABLE V

Grain Thickening as a Function of Chemical Sensitization Temperature

| Sample | Temperature °C. | Mean Thickness (μm) |
|---|---|---|
| Example 35 | N.A. | 0.050 |
| OCS ONLY | 45 | 0.050 |
| OCS ONLY | 50 | 0.053 |
| OCS ONLY | 55 | 0.060 |
| OCS + GEL | 65 | 0.070 |

N.A. = Not applicable, thickness before chemical sensitization

Table V shows the result of sensitizing OCS ONLY at temperatures of 45°, 50°, and 55° C. and OCS+GEL at a temperature of 65° C. The temperature of 65° C. was chosen for OCS+GEL, since this was the lowest chemical sensitization temperature observed to produce a sensitivity level comparable to that OCS ONLY. After chemical sensitization at a temperature of 65° C., the resulting average thickness of the tabular grains was no longer <0.02 μm—i.e., no longer ultrathin. Hence the thickness advantage of ultrathin tabular grain emulsions was lost.

EXAMPLES 46 TO 48

These exampled demonstrate the performance of the emulsions in radiographic film structures.

EXAMPLE 46

Emulsion A(SXR) Chemical Sensitization

To 0.035 mole of the emulsion of Example 1 at 40° C., with stirring, were added sequentially the following solutions containing (mole/mole Ag); 2.5 of NaSCN, 0.22 of a benzothiazolium salt, 1.5 of anhydro-5,5'-dichloro-3,3'-bis (3-sulfopropyl)thiacyanine hydroxide, triethylammonium salt, and 0.08 of 1-(3-acetamidophenyl)-5-mercaptotetrazole, sodium salt. The pH was adjusted to 5.9. Then the following solutions were sequentially added (mole/mole Ag) 0.023 of 2-propargylaminobenzoxazole, 0.036 of 1,3-dicarboxymethyl-1,3-dimethyl-2-thiourea, and 0.014 of bis(1,3,5-trimethyl-1,2,4-triazolium-3-thiolate) gold (I) tetrafluoroborate. The mixture was heated to 55° C. at a rate of 5° C. per 3 min, and held at this temperature for 15 min. Upon cooling to 40° C., a solution of 1.68 of 5-bromo-4-hydroxy-6-methyl-1,3,3a,7-tetraazaindene was added.

Film Coatings

COATING AI

The anionic starch FILMKOTE® 54, obtained from National Starch and Chemical Co., Bridgewater, N.J., is a corn starch consisting of approximately 25% amylose and 75% amylopectin and treated with octenylsuccinic anhydride.

To 2 g of FILMKOTE® 54, was added 19 g of distilled water and the mixture boiled for 30 min with stirring. The weight was restored to 21 g. The pH was adjusted to 5.9 at 40° C. Then 5.8 mmole of Emulsion A(SXR), a solution containing 0.16 g of bis(vinylsulfonyl)methane hardener, surfactant, and distilled water to 42 g, were added. The mixture was hand coated on gelatin-subbed cellulose acetate film support to give an expected coverage of 1.5 g/m$^2$ silver and 4.3 g/m$^2$ starch. No gelatin was present in the emulsion layer.

COATING AII

To 20 g of a 5 percent bone gelatin solution, adjusted to pH 5.9 at 40° C., were added 5.8 mmole of Emulsion A(SXR), a solution containing 0.036 g of bis(vinylsulfonyl) methane hardener, surfactant, and distilled water to 42 g. The mixture was handcoated on a cellulose acetate film support to give an expected coverage of 1.5 g/m$^2$ silver and 4.3 g/m$^2$ of gelatin.

Sensitometric Comparisons

After storage for 2 weeks to allow the hardener to function, Coating AI and Coating AII were exposed to white light for 0.02 sec through a 0 to 4.0 density graduated step-tablet. The exposed films were processed using a commercial Kodak RP X-Omat™ rapid processor as follows: development 20 sec at 40° C., fixing 12 sec at 40° C., washing 8 sec at 40° C. and drying 20 sec at 65° C.

Coating AI had a Dmax of 1.08, Dmin of 0.37, relative speed (at 0.2 above Dmin) of 89 and a mid-scale contrast of 0.51. Coating AII had a Dmax of 1.81, Dmin of 0.68, relative speed (at 0.2 above Dmin) of 100 and a mid-scale contrast of 0.52.

Image Tone Comparisons

The tone of the silver images obtained upon exposure and processing of the radiographic elements were evaluated using the following procedure:

The visible transmitted light absorption spectrum was recorded through silver image regions of uniform optical density using a Hitachi Model U-3410 spectrophotometer (commerciall available from Hitachi Instruments, Danbury, Conn.) The color for each region was then denfined by calculation of the CIE (Commission International de l'Eclairage or International Commission on Illumination) tristiulus values, which combines the energy spectrum of the sample with a given illuminant and the CIE standard color functions. The standard illuminant used was the CIE illuminant $D_{65}$ representing average daylight. CIE LAB values of b* were obtained by mathematical transforms.

The b* values indicate the yellow-blue balance and are a good indicator of warm or cold image tone. A change of approximately 0.7 in the b* value is generally accepted as the just noticeable difference in color which can be detected by observation with the unaided human eye. Increasingly positive values of b* correspond to increasing warmth (yellow hues) of the image. A shift toward negative values and increasingly negative values of b* indicate a shift toward or a cold (blue hue) silver images.

The resulting tone value for each coating, b*, was measured on the film samples at a density of 1.0. The results are summarized in Table VI.

TABLE VI

| Coating | Coating Binder | b* |
|---|---|---|
| AI | starch | 2.96 |
| AII | gelatin | 5.12 |

From the b* values reported in Table VI, it is apparent that the film coating using starch as the only vehicle gave a much improved image tone than the coating that used gelatin as the binder portion of the vehicle.

Optical photomicrographs at 1500× of a low density portion of the image showed that the developed silver of Coating AI was rod to filamentary in shape while the developed silver of Coating AII was spherical to pseudomorphic. This difference in morphology is believed to have resulted in the observed difference in image tone.

EXAMPLE 47

The coating used in this example was prepared similarly to that of Coating AI, except that the emulsion-starch-hardener mixture was handcoated on both sides of a gelatin-subbed Estar® poly(ethylene terephthalate) film support to give an expected coverage of 3.0 g/m$^2$ silver and 8.6 g/m$^2$ starch. No gelatin was present in the emulsion layer.

The resulting dual coated radiographic film was exposed and processed as in Example 48. The resulting tone value b* measured at a density of 1.0 was 2.44.

EXAMPLE 48

Emulsion B AgBr Tabular Grain Emulsion Made Using a Cationic Potato Starch

A cationic starch solution was prepared by boiling for 30 min a stirred mixture of 40 g STA-LOK® 400, 27 mmoles of NaBr, and distilled water to 4 L. The resulting solution was cooled to 35° C., readjusted to 4 L with distilled water, and the pH was adjusted to 6.0.

To a vigorously stirred reaction vessel containing the starch solution at 35° C., a 2.0M $AgNO_3$ solution was added at 100 mL per min for 0.2 min. Concurrently a 2.5M NaBr solution was added initially at 100 mL per min and then at a rate needed to maintain a pBr of 2.21. Then the addition of the solutions was stopped, 25 mL of 2.0M NaBr solution was rapidly added and the temperatures of the contents of the reaction vessel was increased to 60° C. at a rate of 5° C. per 3 min. The pH was adjusted to 6.0 and maintained at this value for the duration of the precipitation. At 60° C., the $AgNO_3$ solution was added at 10 mL per min and the 2.5M NaBr solution was added at a rate needed to maintain a pBr of 1.76. After 3 min of precipitation at this pBr, the flow of the 2.5M NaBr solution was stopped until a pBr of 2.00 was reached. The addition of the $AgNO_3$ solution was stopped and a solution consisting of 40 g STA-LOK® 400, 10 mmoles of NaBr, and distilled water to 1 L that was boiled for 30 min and at 60° C. was added to the reaction vessel. The $AgNO_3$ solution flow rate was resumed at 10 mL per min and accelerated to 40 mL per min in 60 min and held at this rate until a total of 2 L of $AgNO_3$ solution was added. The NaBr solution was added as needed to maintain a pBr of 2.00. Then only the $AgNO_3$ solution was added at 10 mL per min until the pBr reached 3.04 then the NaBr solution was concurrently added to maintain this pBr for 20 min. A total of 4.53 moles of silver was added.

The resulting tabular grain emulsion was washed by diafiltration at 40° C. The tabular grains had an average equivalent circular diameter of 1.3 μm, an average thickness of 0.08 μm, and an average aspect ratio of 16. The tabular grain population made up 95% of the total projected area of the emulsion grains.

Emulsion B(SX) Chemical Sensitization

Emulsion B was chemically and spectrally sensitized to green light. The sensitization used potassium tetrachloroaurate, sodium thiocyanate, sodium thiosulfate, potassium selenocyanate, 350 mg/Ag mole potassium iodide and anhydro-5,5'-dichloro-9-ethyl-3,3'-di-(3-sulfopropyl) oxacarbocyanine hydroxide, triethylamine salt.

Film Coatings

COATING BI

This coating was made similarly to that of Coating AI, except that Emulsion B(SX) was used. No gelatin was present in the emulsion layer.

COATING BII

This coating was made similarly to that of Coating AII, except that Emulsion B(SX) was used.

Image Tone Comparisons

These two film coatings were exposed and processed similarly to these of Coating AI and AII. The resulting tone values, b*, were measured on the film samples at a density of 0.9. The results are given in Table VII.

TABLE VI

| Coating | Coating Vehicle | b* |
|---|---|---|
| BI | starch | 1.22 |
| BII | gelatin | 2.47 |

As can be seen in Table VII, the b* values are less than those of Table VI. Other things being equal, thicker tabular grain emulsions tend to give lower b* values (better x-ray image tone). The emulsion coated using starch as the sole vehicle, Coating BI, gave a significantly lower b* value (an improved image tone), than this same emulsion coated with gelatin present as a binder.

The invention has been described in detail with particular reference to preferred embodiments thereof, but it will be understood that variations and modifications can be effected within the spirit and scope of the invention.

What is claimed is:

1. A radiographic element comprised of a transparent film support having first and second major surfaces and a first emulsion layer unit coated on the first major surface of the support, a second emulsion layer unit coated on the second major surface of the support, each of said first and second emulsion layer units including at least one radiation-sensitive emulsion comprised of silver halide grains containing greater than 50 mole percent bromide and less than 4 mole percent iodide, based on silver, with greater than 50 percent of total grain projected area being accounted for by tabular grains having {111} major faces, a spectral sensitizing dye adsorbed to the surfaces of the silver halide grains, and hydrophilic colloid vehicle acting as a peptizer and a binder for the silver halide grains, wherein at least a portion of the vehicle acting as a peptizer is a hydrophilic colloid derived from a water dispersible cationic starch.

2. A radiographic element according to claim 1 wherein the cationic starch is comprised of α-amylose.

3. A radiographic element according to claim 1 wherein the cationic starch is comprised of amylopectin.

4. A radiographic element according to claim 1 wherein the starch contains cationic moieties selected from among protonated amine moieties and quaternary ammonium, sulfonium and phosphonium moieties.

5. A radiographic element according to claim 1 wherein the cationic starch contains α-D-glucopyranose repeating units having 1 and 4 position linkages.

6. A radiographic element according to claim 5 wherein the cationic starch additionally contains 6 position linkages in a portion of the α-D-glucopyranose repeating units to form a branched chain polymeric structure.

7. A radiographic element according to claim 1 wherein the cationic starch is oxidized.

8. A radiographic element according to claim 7 wherein the oxidized cationic starch contains α-D-glucopyranose repeating units and, on average, at least one oxidized α-D-glucopyranose unit per starch molecule.

9. A radiographic element according to claim 8 wherein at least 1 percent of the α-D-glycopyranose units are ring opened by oxidation.

10. A radiographic element according to claim 9 wherein from 3 to 50 percent of the α-D-glycopyranose units are ring opened by oxidation.

11. A radiographic element according to claim 9 wherein the oxidized α-D-glucopyranose units contain two —C(O)R groups, where R in combination with —C(O) completes an aldehyde or carboxyl group.

12. A radiographic element according to claim 8 wherein the oxidized α-D-glucopyranose units are dialdehydes.

13. A radiographic element according to claim 1 wherein the cationic starch is dispersed to at least a colloidal level of dispersion.

14. A radiographic element according to claim 13 wherein the cationic starch is at least in part present as an aqueous solute.

15. A radiographic element according to claim 1 wherein the tabular grains are chemically sensitized.

16. A radiographic element according to claim 15 wherein the tabular grains are chemically sensitized with at least one of sulfur, gold and reduction sensitizers.

17. A radiographic element according to claim 15 wherein a photographic binder is combined with the chemically sensitized tabular grains.

18. A radiographic element according to claim 17 wherein the photographic vehicle contains starch as both a binder and a peptizer.

19. A radiographic element according to claim 18 wherein the tabular grains have an average thickness of less than 0.1 μm.

* * * * *

UNITED STATES PATENT AND TRADEMARK OFFICE

CERTIFICATE OF CORRECTION

PATENT NO. : 5,629,142

DATED : May 13, 1997

INVENTOR(S) : Joe E. Maskasky

It is certified that error appears in the above-indentified patent and that said Letters Patent is hereby corrected as shown below:

Title page, item [60], under Related U.S. Application Data insert--
Provisional application No. 60/002,105 Aug. 10, 1995.--

Signed and Sealed this

Twenty-sixth Day of August, 1997

*Attest:*

Bruce Lehman

BRUCE LEHMAN

*Attesting Officer*

*Commissioner of Patents and Trademarks*